US005455665A

United States Patent [19]

Baba et al.

[11] Patent Number: 5,455,665

[45] Date of Patent: Oct. 3, 1995

[54] CLEANING APPARATUS WITH A MEMBER TO PREVENT PEELING OF A GUIDE MEMBER, AND A PROCESS CARTRIDGE AND IMAGE FORMING APPARATUS USING THE SAME

[75] Inventors: Mutsumi Baba; Takeo Shoji, both of Yokohama; Toshiyuki Karakama, Tokyo; Kazunori Kobayashi, Kawasaki; Toru Oguma, Tokyo, all of Japan

[73] Assignee: Canon Kabushiki Kaisha, Tokyo, Japan

[21] Appl. No.: 14,866

[22] Filed: Feb. 8, 1993

[30] Foreign Application Priority Data

| | | | |
|---|---|---|---|
| Feb. 10, 1992 | [JP] | Japan | 4-057594 |
| Oct. 2, 1992 | [JP] | Japan | 4-264900 |
| Nov. 4, 1992 | [JP] | Japan | 4-318007 |
| Jan. 29, 1993 | [JP] | Japan | 5-013473 |

[51] Int. Cl.[6] ..... G03G 21/00

[52] U.S. Cl. ..... 355/298; 15/256.5; 355/215; 355/296; 355/299

[58] Field of Search ..... 355/296, 298, 355/299, 215, 300, 301, 302, 303; 15/256.5, 256.51, 256.53

[56] References Cited

U.S. PATENT DOCUMENTS

| | | | |
|---|---|---|---|
| 3,848,992 | 11/1974 | Smith | 15/256.51 |
| 4,357,098 | 12/1982 | Endo | 15/256.51 |
| 4,400,081 | 8/1983 | Yamashita et al. | 355/299 |
| 4,561,766 | 12/1985 | Fox | 15/256.51 X |
| 4,802,928 | 2/1989 | Dunlap | 15/256.51 X |
| 5,214,482 | 5/1993 | Katoh | 355/299 X |

FOREIGN PATENT DOCUMENTS

| | | | |
|---|---|---|---|
| 61-110186 | 5/1986 | Japan | 355/299 |
| 1-185587 | 7/1989 | Japan | 355/299 |
| 1-177065 | 7/1989 | Japan | 355/299 |
| 4-101183 | 3/1992 | Japan | 355/299 |
| 4-294381 | 10/1992 | Japan | 355/299 |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

The present invention provides a cleaning apparatus for removing adhered matter from a member to be cleaned. The apparatus includes a cleaning device abutted against the member to be cleaned and adapted to remove the adhered matter from the member to be cleaned. In addition, the apparatus includes a receiving unit for receiving the adhered matter removed from the member to be cleaned, a guide member for directing the removed matter to the receiving unit, an adhesive member for adhering the guide member to the receiving unit, and an end seal member provided on the guide member at an end portion. The adhesive member protrudes from a longitudinal end edge of the guide member.

62 Claims, 19 Drawing Sheets

CLEANING APPARATUS WITH A MEMBER TO PREVENT PEELING OF A GUIDE MEMBER, AND A PROCESS CARTRIDGE AND IMAGE FORMING APPARATUS USING THE SAME

BACKGROUND OF THE INVENTION

1. Field of the Invention

The present invention relates to a cleaning apparatus or device, a process cartridge and an image forming apparatus. The image forming apparatus may be embodied as an electrophotographic copying machine, a laser beam printer, an LED printer, a word processor, a facsimile apparatus or the like.

2. Description of the Art

Conventionally, as a cleaning apparatus used with an image forming apparatus such as an electrophotographic copying machine or the like, the arrangement as shown in FIG. 26 is already known.

In FIG. 26, a cleaning apparatus 7 has a cleaning container (toner containing container) 10 for containing toner. The Cleaning container 10 is provided with an opening 10*a* which faces a photosensitive drum. A cleaning blade 5 is attached to an upper edge portion of the cleaning container 10 above the opening 10*a* via a blade supporting metal plate 11 secured to the container by screws 15. A free edge of the cleaning blade 5 is urged against an outer periheral surface of the photosensitive drum along an axial direction of the drum, thereby removing the residual toner from the photosensitive drum.

Further, a seal member 6 is attached to a lower edge portion of the cleaning container 10 below the opening 10*a*, via an adhesive member 14. A free edge of the seal member 6 is urged against the outer peripheral surface of the photosensitive drum along the axial direction of the drum, thereby collecting the toner removed from the photosensitive drum into the cleaning container 10.

In addition, end leak preventing members 12 are adhered to side edge portions of the cleaning container 10 on both sides of the opening 10*a*. Each end leak preventing member 12 is so designed that the side surface of this member is contacted with the side surface of the cleaning blade 5 having a minimum thickness of about 1–2 mm, and the undersurface of the seal member 6 having a thickness of 30–200 μm is overlapped on the end leak preventing member 12 without a gap therebetween. Thus, the toner contained in the cleaning container 10 is prevented from leaking therefrom.

By the way, in the above-mentioned conventional cleaning apparatus, there arose a problem shown in FIGS. 27A and 27B. FIGS. 27A and 27B are sectional views taken along the line 27A—27A in FIG. 26, where FIG. 27A shows the end leak preventing member immediately after the cleaning apparatus is manufactured, and FIG. 27B shows the end leak preventing member after the cleaning apparatus has been used or left as it is for a long time.

More particularly, an end leak preventing member 12 is attached to the cleaning container in such a manner that the front surface of the end leak preventing member 12 protrudes with respect to the undersurface (surface contacted with the adhesive member 14) of the end leak preventing member 12 by height P so as to seal the gap between the photosensitive drum 1 and the cleaning container 10 to thereby prevent the leakage of the toner. Accordingly, as shown in FIG. 27A, the end of the end leak preventing member 12 is compressed by the seal member 6, with the result that the reaction force F always acts on the seal member 6. Further, the adhesive member 14 such as a both-sided adhesive sheet has a relatively weak adhesion force regarding the resin of which the cleaning container 10 is made. Thus, in many cases, the reaction force F from the end leak preventing member 12 is greater than the adhesion force between the adhesive member 14 and the cleaning container, with the result that, after the cleaning apparatus has been used or left as it is for a long time, the adhesive member 14 as well as the seal member 6 is peeled from the cleaning container 10, thereby creating a gap 17 (FIG. 27B). As a result, it is feared that the toner collected in the cleaning container 10 leaks outwardly from the container through the gap 17.

Incidentally, FIG. 28 shows a condition that the adhesive member 14 and the seal member 6 are peeled from the container. The peeling starts from the end of the seal member 6 and progresses therefrom obliquely, so that the gap 17 is widened in a triangle pattern. The speed of the progress of the peeling depends upon the reaction force F of the end leak preventing member 12, and the term or period of the progress of the peeling often extends over a few days or a few months. If the gap 17 exceeds inwardly from an inner end Q of the end leak preventing member 12, the residual toner will leak from the container; and, even when the gap does not reach the inner end Q of the end leak preventing member, if the cleaning apparatus is subjected to any vibration, it is feared that the toner leaks from the cleaning apparatus.

SUMMARY OF THE INVENTION

An object of the present invention is to provide a cleaning apparatus or device, a process cartridge and an image forming apparatus which can prevent toner from leaking.

Another object of the present invention is to provide a cleaning apparatus or device, a process cartridge and an image forming apparatus which can improve the toner seal ability remarkably.

A further object of the present invention is to provide a cleaning apparatus or device, a process cartridge and an image forming apparatus which can improve an adhesion holding force for adhering a toner seal member remarkably.

A still further object of the present invention is to provide a cleaning apparatus or device, a process cartridge and an image forming apparatus which can obtain an image with high quality and without adhesion of toner.

The other object of the present invention is to provide a cleaning apparatus or device, a process cartridge and an image forming apparatus which can prevent toner from leaking by improving a sealing function.

DETAILED DESCRIPTION OF THE PREFERRED EMBODIMENTS

Figure 26:
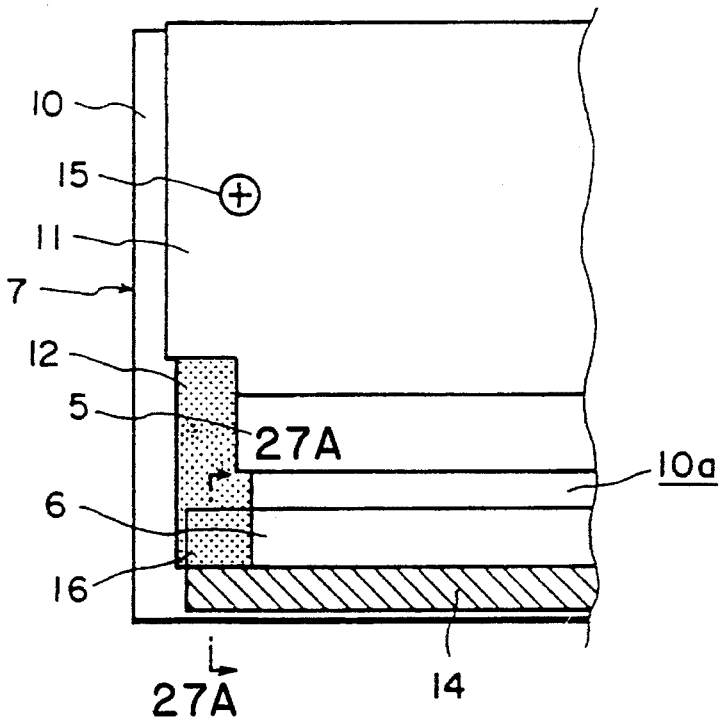
FIG. 26 PRIOR ART
FIG. 26 is a partial view of a conventional cleaning apparatus.
Figure 27A:
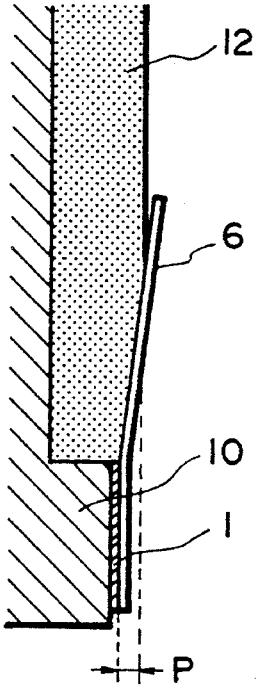
FIG. 27A PRIOR ART
FIGS. 27A and 27B are sectional views taken along the line 27A—27A in FIG. 26, for explaining the conventional drawback.
Figure 27B:
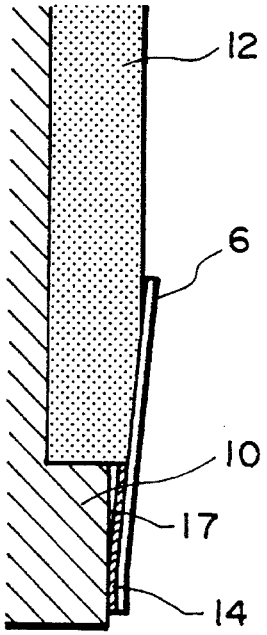
FIG. 27B PRIOR ART
Figure 28:
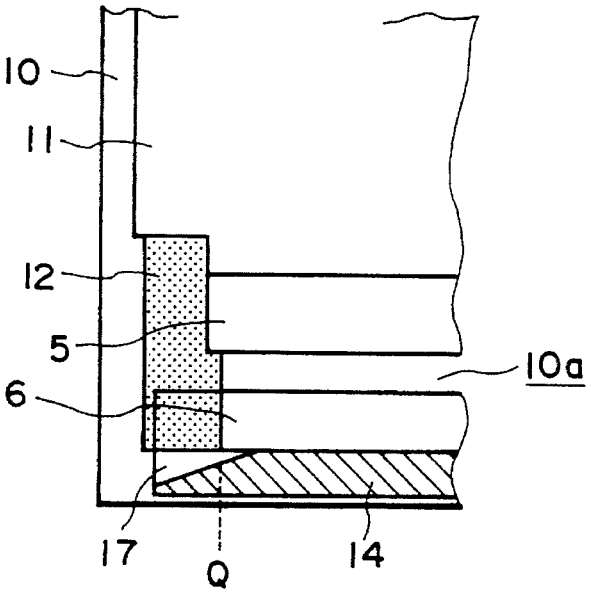
FIG. 28 PRIOR ART
FIG. 28 is a partial view for explaining the conventional drawback.

The present invention will now be explained in connection with embodiments thereof with reference to the accompanying drawings. Incidentally, the same structural elements as those shown in FIGS. 26 to 28 showing the conventional cleaning apparatus are designated by the same reference numerals.

Figure 1:
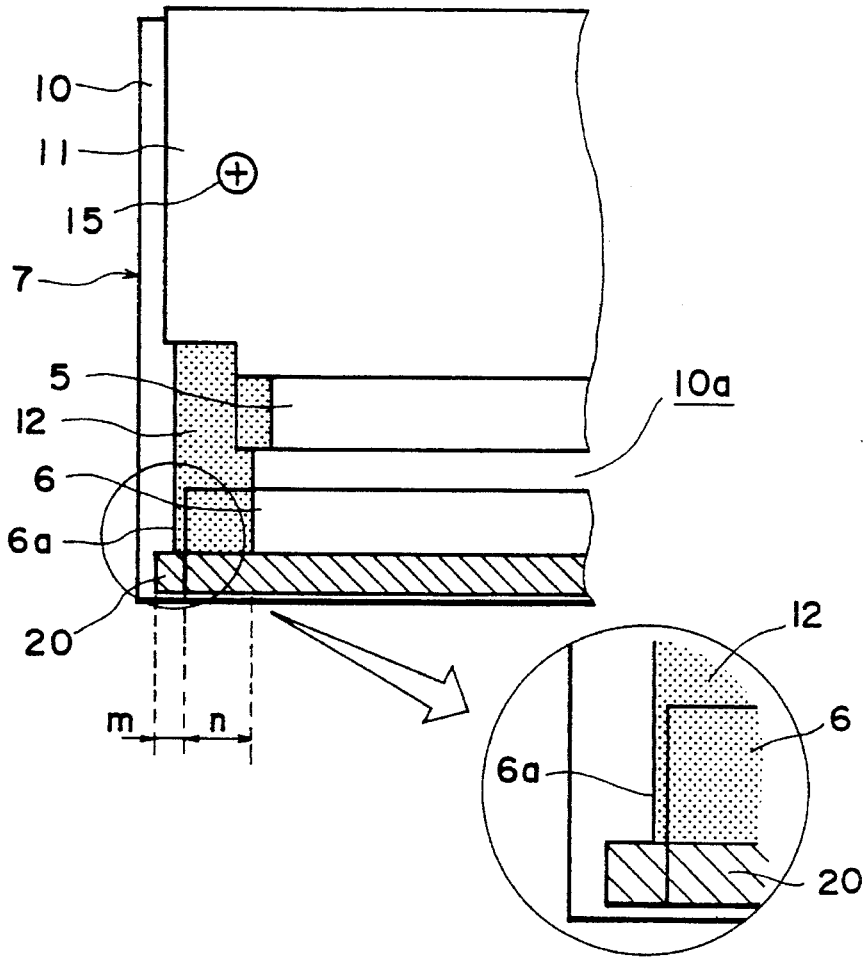
FIG. 1 is a partial side view of a cleaning apparatus according to a preferred embodiment of the present invention.

In FIG. 1 showing a cleaning apparatus according to a preferred embodiment of the present invention as a partial side view, a cleaning blade 5 attached to a cleaning container (toner containing container) 10 via screws 15 and a blade supporting metal plate 11 is urged against a photosensitive drum with a force or pressure of 25 g/cm. Further, an end leak preventing member 12 made of foam polyurethane is closely contacted with a side surface of the cleaning blade 5 and a portion of the end leak preventing member is contacted with a back surface (remote from the photosensitive drum) of the cleaning blade 5. As shown in FIG. 1, a both-sided adhesive sheet (adhesive member) 20 (in this embodiment, "DIC #8103D" manufactured by DAINIHON INKI KOGYO Co., Ltd. in Japan is used) for adhering a seal member (guide member) 6 to the cleaning container 10 is adhered to the cleaning container 10 in such a manner that an end of the adhesive sheet protrudes from an end edge 6*a* of the seal member 6 abutted against the end leak preventing member 12 (referred to as "seal member end edge" hereinafter) by a distance m (in this embodiment, $m \geqq 3$ mm). Further, the back surface of the seal member 6 is overlapped with the end leak preventing member by a distance n (in this embodiment, n=7 mm).

With this arrangement, even if a reaction force from the end leak preventing member 12 acts on the both-sided adhesive sheet 20 via the seal member 6, the both-sided adhesive sheet 20 is firmly adhered to the cleaning container 10 at the area m on which the reaction force does not act. Thus, the adhesion between the seal member 6 and the cleaning container 10 is maintained. As a result, the both-sided adhesive sheet 20 will be difficult to be peeled from the cleaning container 10, thus effectively preventing the toner from leaking between the seal member 6 and the container 10.

It was found that, after the process cartridge having the aforementioned cleaning apparatus has been left as it is for four weeks under the constant temperature of 50° C., the both-sided adhesive sheet 20 was not peeled from the cleaning container 10 at all. Further, when the process cartridge was incorporated into an electrophotographic copying machine and 10,000 copies were obtained, it was found that there was no leak of toner.

Figure 2:
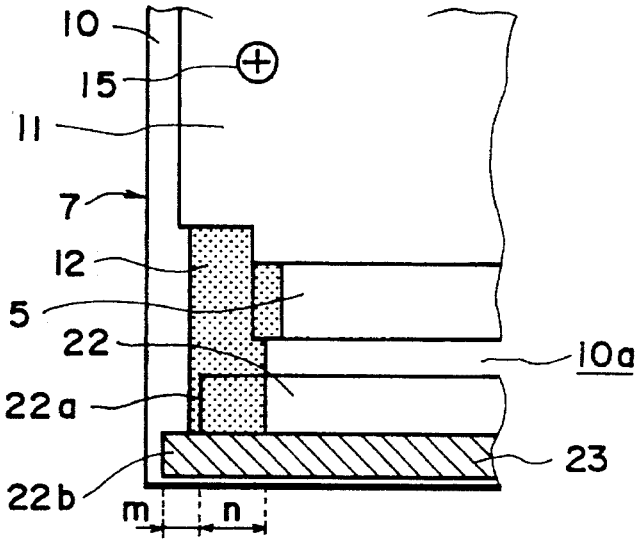
FIG. 2 is a partial side view of a cleaning apparatus according to another embodiment of the present invention.

Next, another embodiment of the present invention will be explained with reference to FIG. 2.

Also in this embodiment, a seal member (guide member) 22 is adhered to a cleaning container 10 via an adhesive member 23. An end edge of the adhesive member 23 protrudes from an end edge 22*a* of the seal member 22 by a distance m (m=3 mm). In this embodiment, the seal member 22 is so shaped that it has an adhesive extension 22*b* protruded from the end edge 22*a* to cover the adhesive member 23. That is to say, in this embodiment, the seal member 22 has a stepped configuration so that it is adhered to the container 10 with a wider area via the adhesive member 23.

With this arrangement, the adhesive member 23 which is a both-sided adhesive sheet is adhered to the cleaning container 10 at a section which protrudes from the seal member end edge 22*a* by the distance m (=3 mm) and which is not subjected to the reaction force from the end leak preventing member 12. Thus, even if the reaction force from the end leak preventing member 12 acts on the adhesive member 23 via the seal member 22, the adhesive member 23 will be not peeled from the cleaning container 10. Further, since the seal member 22 has the adhesive extension 22*b* protruded from the seal member end edge 22*a*, it is possible to prevent the peeling between the seal member 22 and the adhesive member 23. Accordingly, also in this embodiment, the adhesion force between the adhesive member 23 and the cleaning container 10 and the adhesion force between the adhesive member 23 and the seal member 22 are both increased, thereby preventing the toner from leaking between the cleaning container 10 and the seal member 22.

Figure 3A:
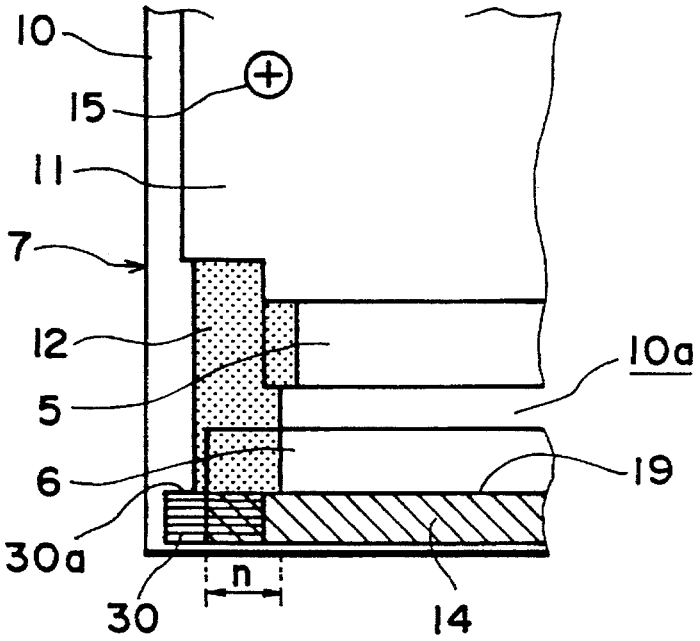
FIG. 3A is a partial side view of a cleaning apparatus according to further embodiment of the present invention.
Figure 3B:
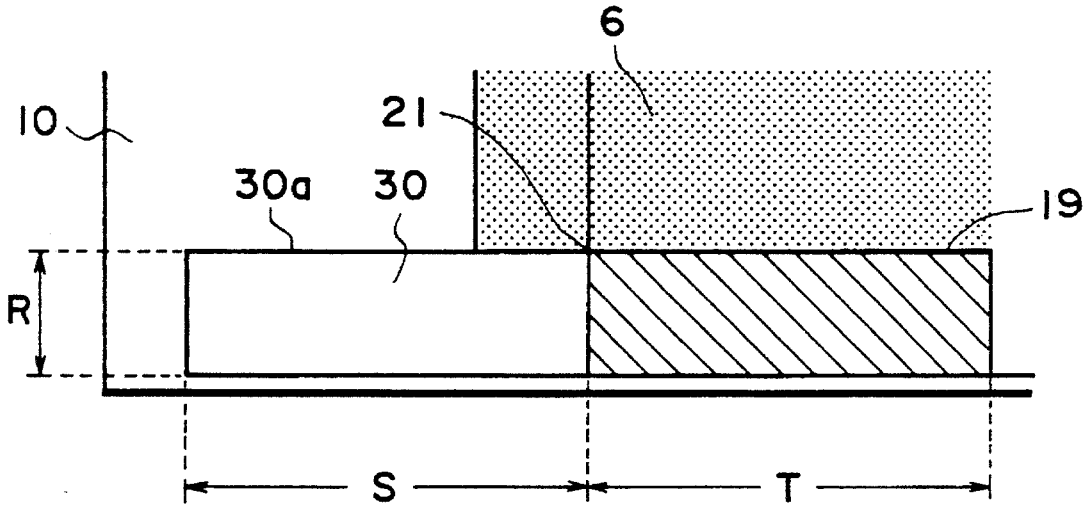
FIG. 3B is a partial enlarged view of the apparatus of FIG. 3A.

A further embodiment of the present invention will be explained with reference to FIGS. 3A and 3B.

In this embodiment, a side surface of a cleaning blade 5 (made of urethane rubber) attached to a cleaning container (toner containing container) 10 via screws 15 and a blade supporting metal plate 11 is closely contacted with a side surface of an end leak preventing member (second seal member) 12, and a portion of the end leak preventing member 12 is disposed on the back surface of the blade 5. Further, a seal member 6 is overlapped with the end leak preventing member 12 by a distance n (n=7 mm). In this embodiment, a sheet-shaped adhesive tape (peel preventing seal member) 30 having an adhesive layer on its one surface is adhered to and across the end portion of the seal member 6 and the cleaning container 10. Incidentally, as best shown in FIG. 3B, the adhesive tape 30 is adhered to the container in such a manner that an end edge 30*a* of the tape coincides with an upper edge 19 of a seal member adhesion surface of the cleaning container 10. Further, in this embodiment, a length L through which the adhesive tape 30 is overlapped with the seal member 6 and a length S that the adhesive tape 30 protrudes are the same (about 5 mm), and a width R of the adhesive tape 30 is about 3 mm.

With this arrangement, even if the reaction force from the end leak preventing member 12 acts on the seal member 6, an area near a point 21 from which the peeling of the seal member 6 starts is firmly adhered to the cleaning container 10 by the adhesive tape 30 without the influence of the reaction force. Thus, no gap between the seal member 6 and the cleaning container 10 is created, thereby preventing the leakage of the toner.

It was found that, after the process cartridge having the aforementioned cleaning apparatus has been left as it is for six months under the high temperature and high humidity condition (50° C./90% RH), the both-sided adhesive tape 30 was not peeled from the cleaning container 10 at all.

Figure 4A:
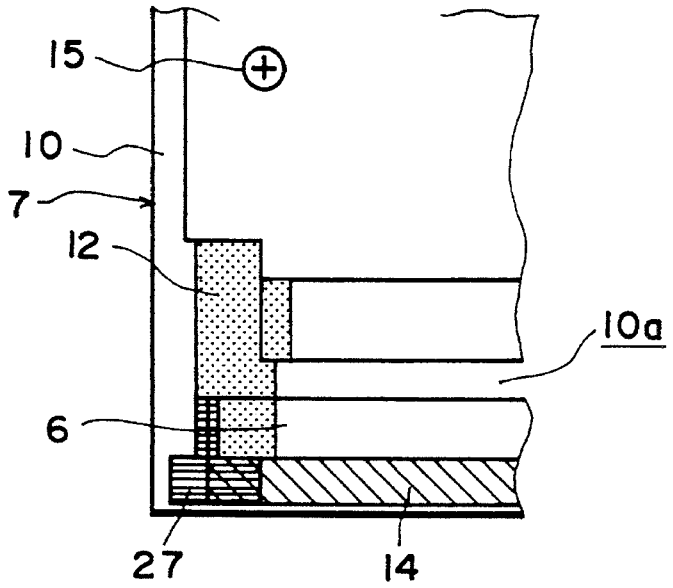
FIG. 4A is a partial side view of a cleaning apparatus according to a still further embodiment of the present invention.
Figure 4B:
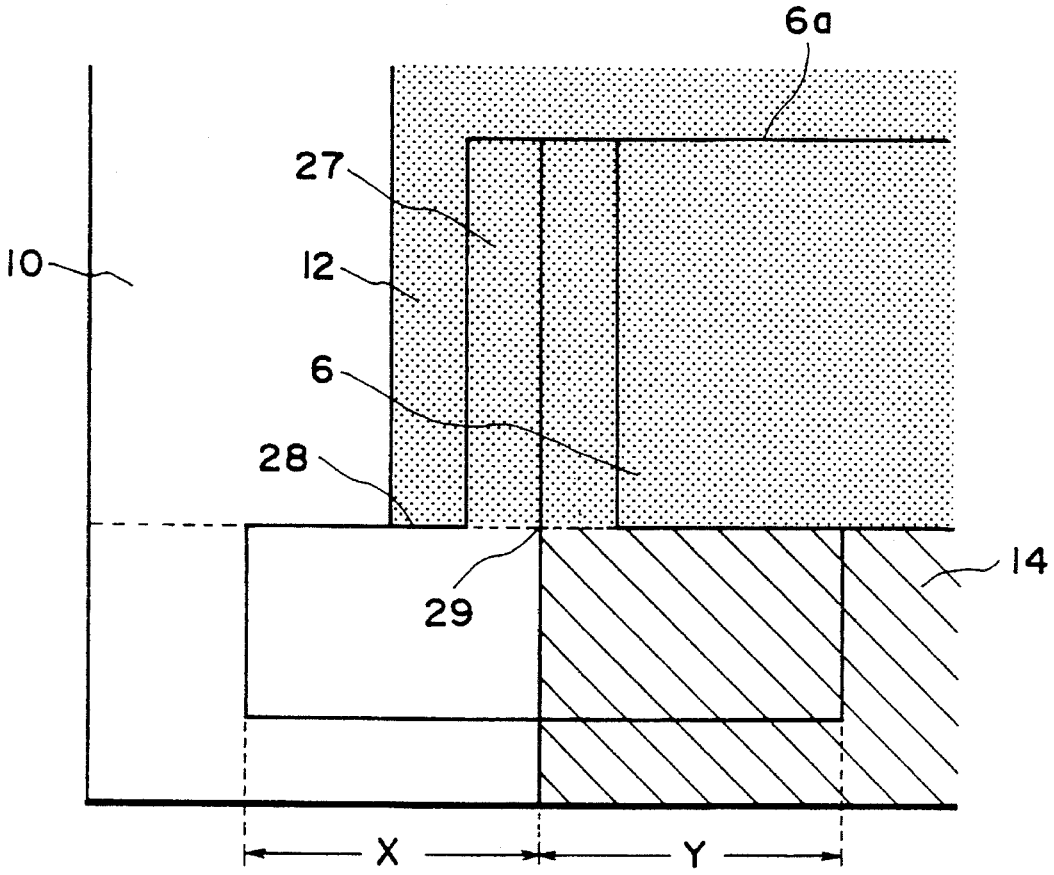
FIG. 4B is a partial enlarged view of the apparatus of FIG. 4A.

Next, a still further embodiment of the present invention will be explained with reference to FIGS. 4A and 4B.

In this embodiment, a peel preventing seal member 27 has a T-shaped configuration. The peel preventing seal member 27 is adhered to and across not only a seal member 6, a cleaning container 10 but also an end leak preventing member 12. In this embodiment, a length Y through which the peel preventing seal member 27 is overlapped with the seal member 6 and a length X through which the peel preventing seal member is overlapped with a seal member adhesion surface of the cleaning container 10 are the same (about 5 mm), and a non-adhered portion at an end portion of the seal member is covered up to an end 6*a* thereof.

With this arrangement, even if the reaction force from the end leak preventing member acts on the peel preventing seal member, a peel starting point 29 is not peeled from the cleaning container, because of the adhesion holding force between the peel preventing seal member 27 and the cleaning container 10. Further, since the end leak preventing member 12 and the end portion of the seal member are wholly covered by the peel preventing seal member 27, it is possible to prevent the bending of the seal member when the photosensitive drum 1 is installed, and, therefore, to prevent the leakage of the toner due to the bending of the seal member.

Figure 5A:
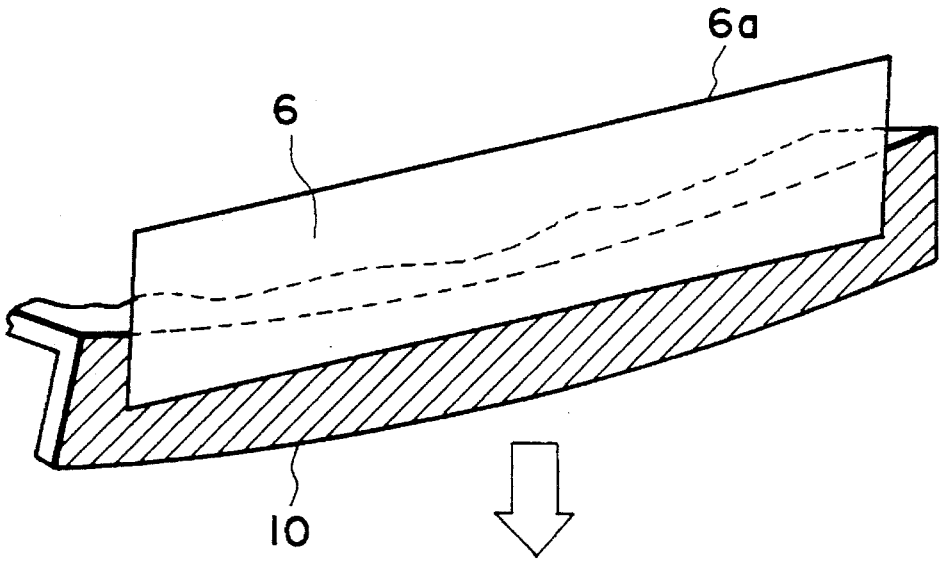
FIGS. 5A and 5B are views showing a manner that a seal member is attached.
Figure 5B:
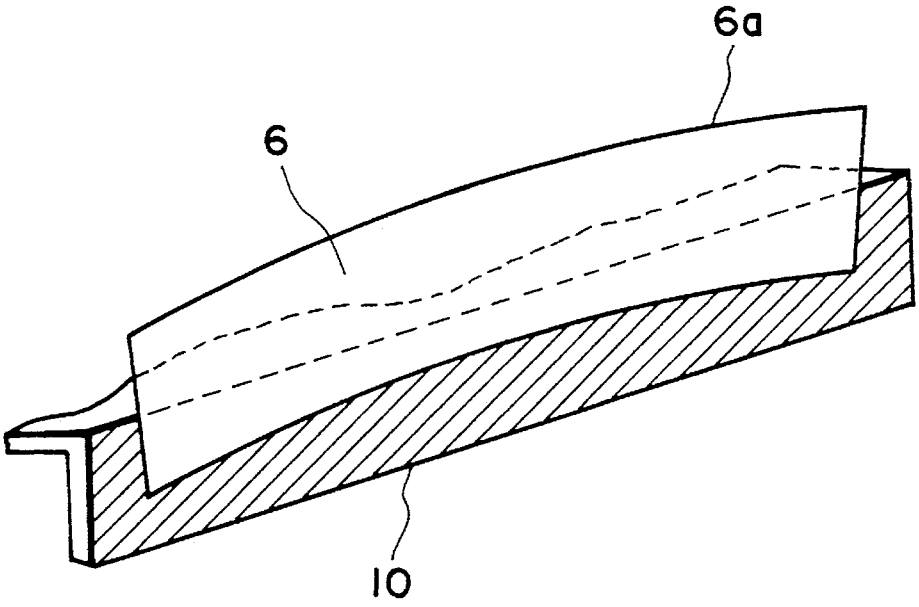

Next, a further embodiment of the present invention will be explained with reference to FIGS. 5A and 5B.

In this embodiment, a seal member 6 is directly adhered to a cleaning container 10 while acting the residual stress on a free edge 6*a* of the seal member. In order to adhere the seal member 6 to the container, the cleaning container 10 is previously bent or curved by applying a force to the container in a direction shown by the arrow in FIG. 5A, and the seal member 6 is adhered to the curved container. Then, as shown in FIG. 5B, when the force applied to the cleaning container 10 is released, the cleaning container 10 is returned to its original configuration, with the result that the longitudinal tension force is applied to the free edge 6*a* of the seal member 6. Incidentally, the manner that the seal member 6 is adhered to the cleaning container 10 may be the same as that described in connection with the embodiment shown in FIG. 1, 2, 3 or 4.

With this arrangement, as similar to the above-mentioned embodiments, it is possible to prevent the leakage of the toner, and, since the free end of the seal member 6 is subjected to the longitudinal tension force, the seal member can be adhered to the cleaning container with high accuracy and without any unduration.

Figure 6:
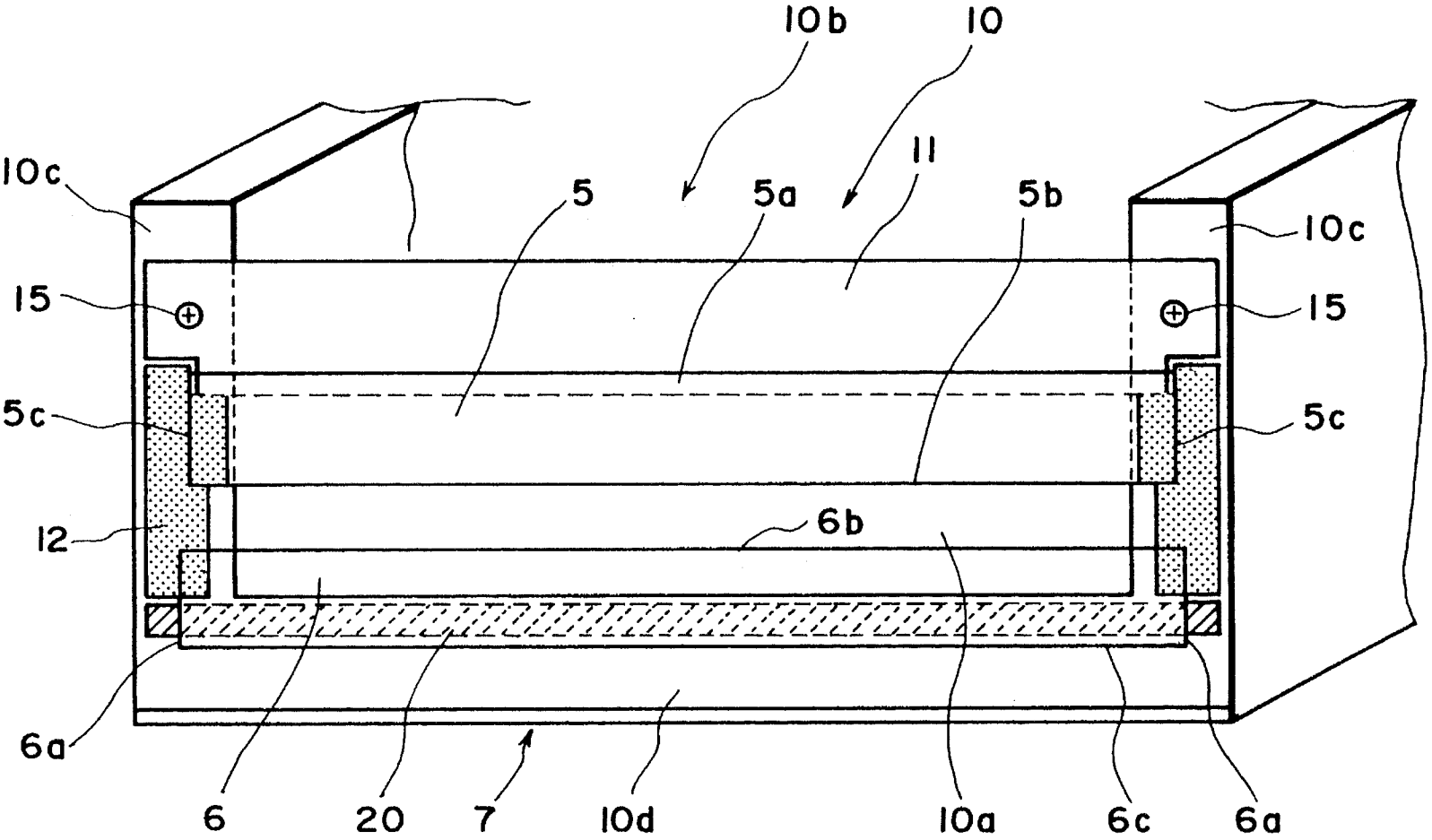
FIG. 6 is a partial perspective view of a cleaning apparatus according to a further embodiment of the present invention.

Next, a cleaning apparatus to which the above-mentioned embodiments can be applied will be explained with reference to FIG. 6. FIG. 6 is a perspective view of such cleaning apparatus which is designed in accordance with the embodiment of FIG. 1 as an example. Of course, the cleaning apparatus may be designed in accordance with one of the other embodiments.

In FIG. 6, a cleaning container 10 has a containing portion 10*b* into which toner removed from the photosensitive drum by a cleaning blade 5 is collected. Incidentally, the toner removed from the photosensitive drum by the blade 5 reaches the containing portion 10*b* through an opening 10*a*. In this case, a first seal member 6 is lightly urged against the surface of the photosensitive drum so that the residual toner on the photosensitive drum can pass through the seal member, but the toner removed from the photosensitive drum by the blade 5 is directed to a direction away from the surface of the photosensitive drum. The removed toner which is guided by the seal member 6 reaches the containing portion 10*b*. Further, a rear edge portion 5*a* of the blade 5 is adhered to a blade supporting metal plate 11 by an adhesive, and a front edge 5b of the blade is urged against the photosensitive drum along the thrust direction of the drum. The supporting metal plate 11 is secured to side walls 10c of the container 10 by screws 15.

In this embodiment, a rear end portion 6c of the seal member 6 is adhered to a bottom portion 10d of the container 10 by a both-sided adhesive tape 20 while lightly urging a front edge 6b of the seal member 6 against the photosensitive drum. The both-sided adhesive tape 20 protrudes from both end edges 6a of the seal member 6 by a distance of about 1.0– 5.0 mm, respectively, and the protruded portions are adhered to the container 10.

Further, each of end leak preventing members 12 is closely contacted with a longitudinal end edge 5c of the blade 5 and a longitudinal end edge 6a of the seal member 6, and a portion of each end leak preventing member is disposed on the back surfaces of the blade 5 and seal memeber 6 (surfaces remote from the photosensitive drum, i.e., between the blade 5 and the container 10, and between the seal member 6 and the container 10). Each end leak preventing member 12 is disposed between an end edge of a longitudinal non-adhered portion of the seal member 6 and the container 10. Incidentally, in this embodiment, while each end leak preventing member 12 was contacted with both the end edges of the blade 5 and the seal member 6, each end leak preventing member may be constituted by two pieces each contacting with the end edges of the blade and the seal member, respectively.

In this embodiment, it was found that, when the seal member 6 having a length of about 241 mm, a width of about 7–9 mm and a thickness of about 30– 200 μm and made of polyethylene terephthalate was adhered to the container by using the both-sided adhesive tape (DIC #8103D manufactured by DAINIHON INKI KOGYO CO., Ltd.) having a length of about 247 mm (protruding from each end edge 6a of the seal member 6 by about 3 mm, respectively) and a width of about 3 mm, an adequate adhesion holding force could be obtained in a practical use.

Incidentally, regarding the material for various members, it is desirable that the cleaning blade is made of an elastic body such as urethane rubber or silicone rubber. Further, the seal member 6 is desirably made from a thin sheet made of urethane, polyethylene terephthalate (PET) or the like. Furthermore, the end leak preventing member 12 is desirably made of foam material such as sponge or the like. Further, the cleaning container 10 is desirably made of resin such as polystyrol, polyphenylene ether or the like.

Next, an example of a both-sided adhesive tape which can be applied to this embodiment will be explained with reference to FIG. 7.

Figure 7:
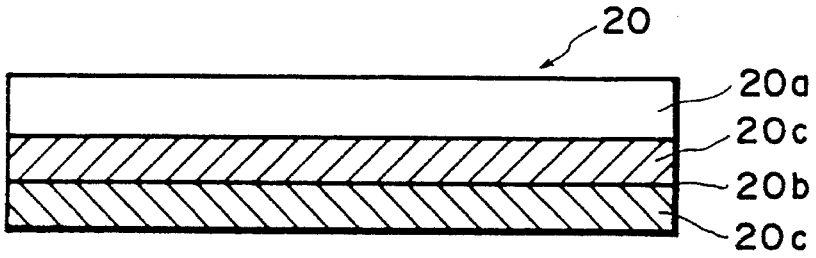
FIG. 7 is a side view of a both-sided adhesive tape according to a preferred embodiment.

In FIG. 7, the both-sided adhesive tape comprises a substrate or base member 20b on both surfaces of which adhesive layers 20c each having the adhesion ability are coated. The adhesive tape is used after a protection paper sheet 20a on the adhesive layer is peeled.

Next, further embodiments of the present invention will be explained with reference to FIGS. 8 and 9.

Figure 8:
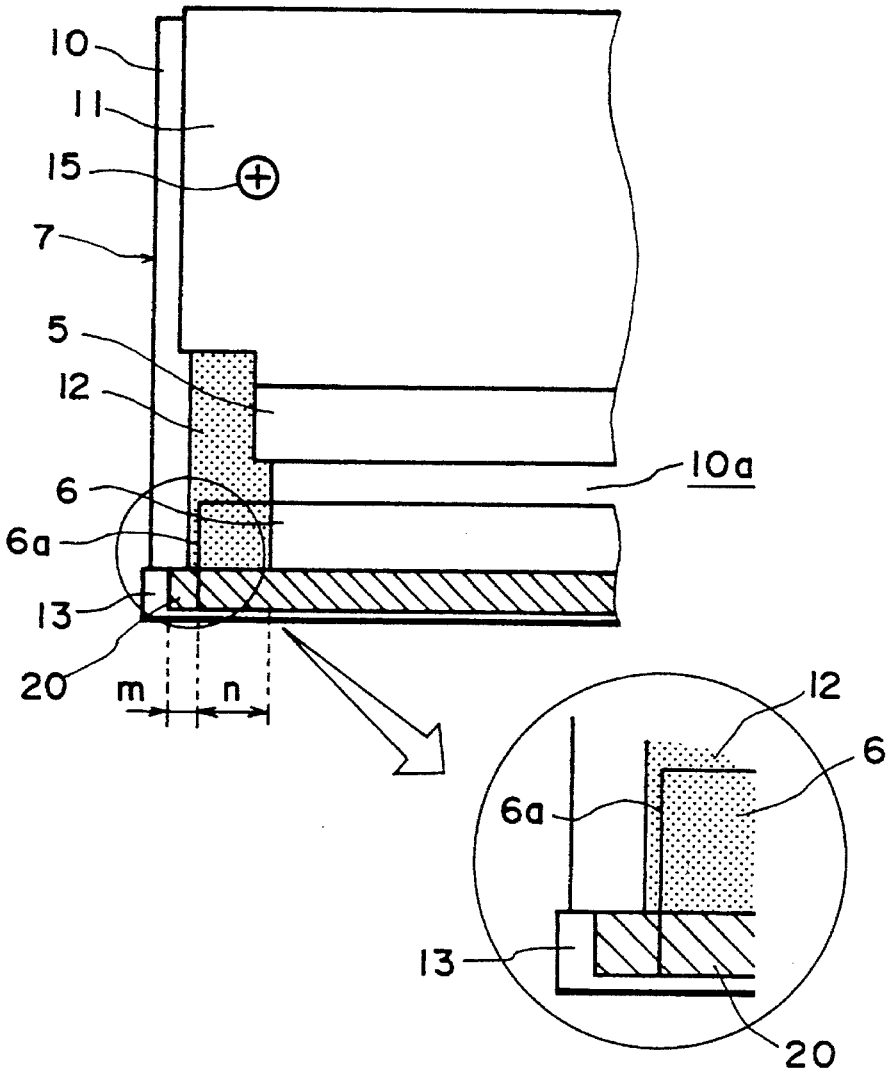
FIG. 8 is a partial side view of a cleaning apparatus according to a still further embodiment of the present invention.
Figure 9A:
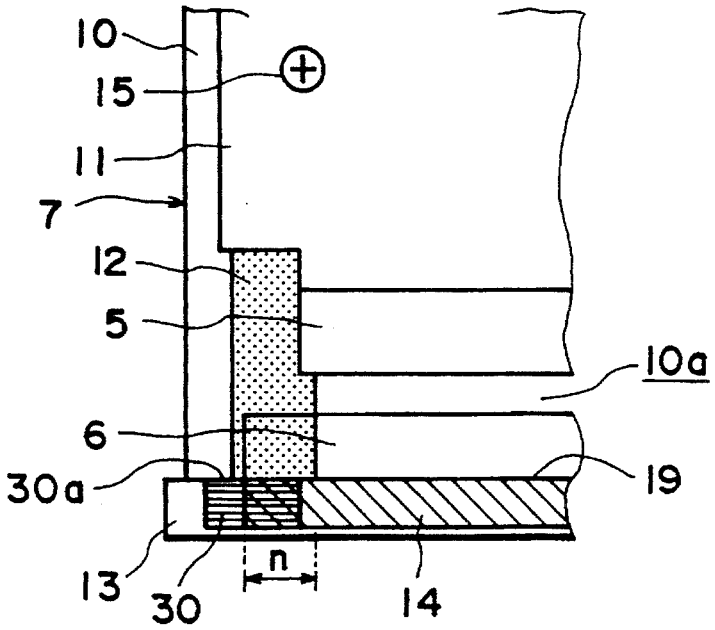
FIG. 9A is a partial side view of a cleaning apparatus according to a further embodiment of the present invention.
Figure 9B:
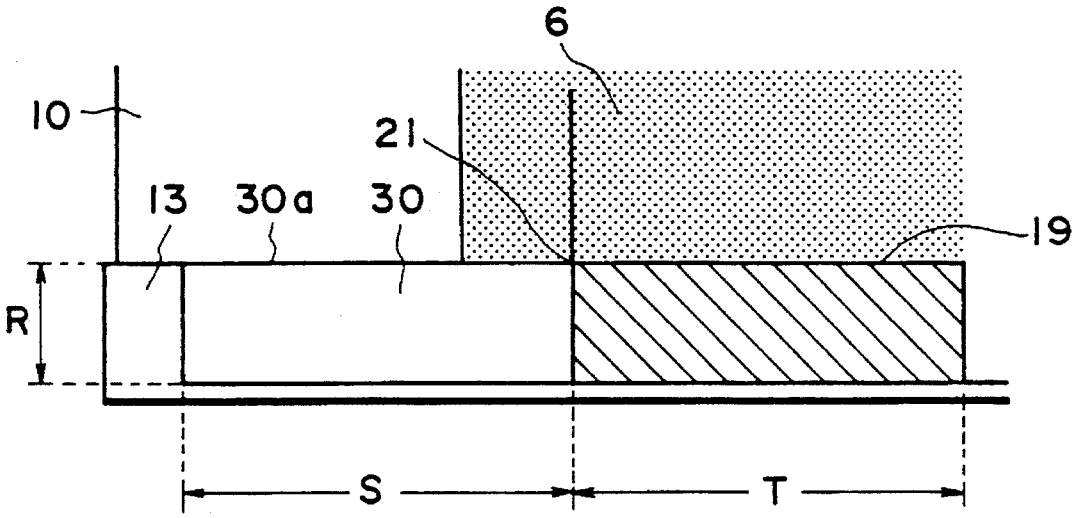
FIG. 9B is a partial enlarged view of the apparatus of FIG. 9A.

In the above-mentioned embodiments, while the seal member 6 was adhered to the container 10, in embodiments shown in FIGS. 8 and 9, a seal member 6 is adhered to an intermediate member 13 (which preferably comprises a rigid body such as a metal plate, plastic plate or the like) via an adhesive member 20. The manner that the seal member 6 is adhered to the intermediate member 13 is the same as the manner that the seal member is adhered to the container 10 in the aforementioned embodiments. After the seal member 6 is adhered to the intermediate member 13, the latter is adhered to a cleaning container 10 by an adhesive or is mechanically secured to the cleaning container by screws. Incidentally, since the embodiments shown in FIGS. 8 and 9 are the same as those shown in FIGS. 1 and 3, respectively, except that the seal member 6 is attached to the cleaning container 10 via the intermediate member 13, the detailed explanation will be omitted and the related description regarding FIGS. 1 and 3 is to be referred to, if necessary.

Figure 10:
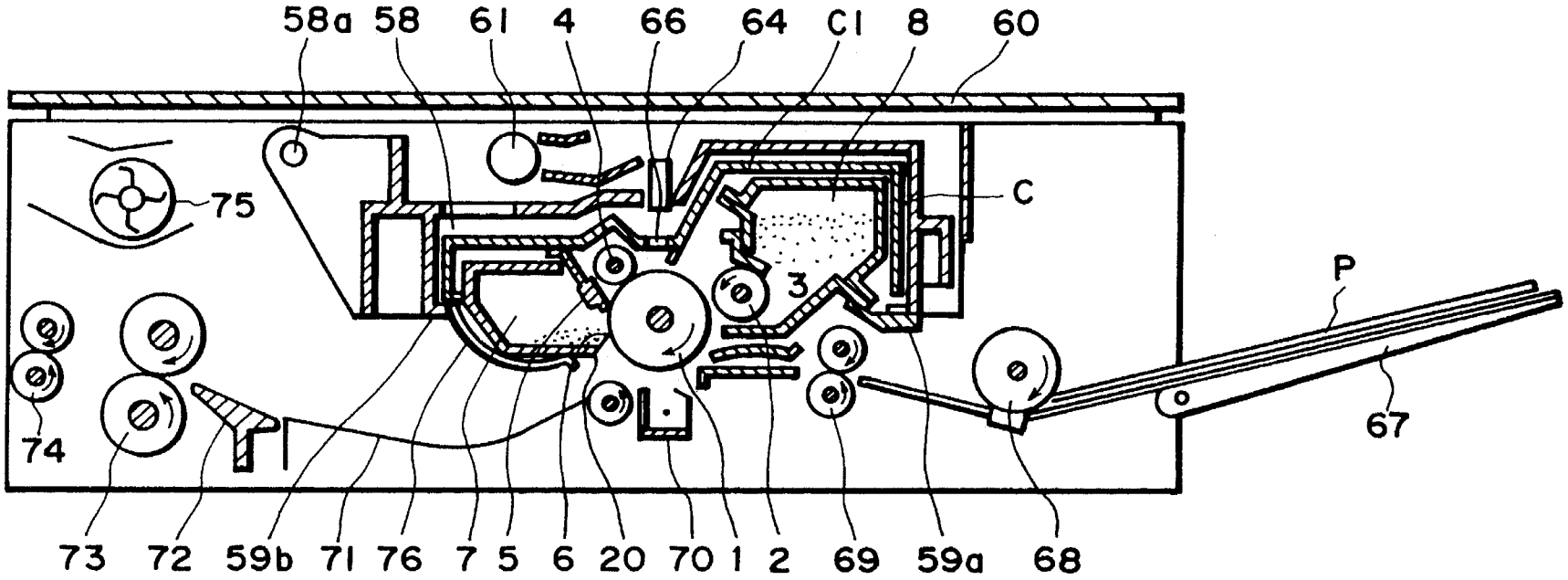
FIG. 10 is a sectional elevational view of an image forming system according to a preferred embodiment of the present invention.
Figure 11:
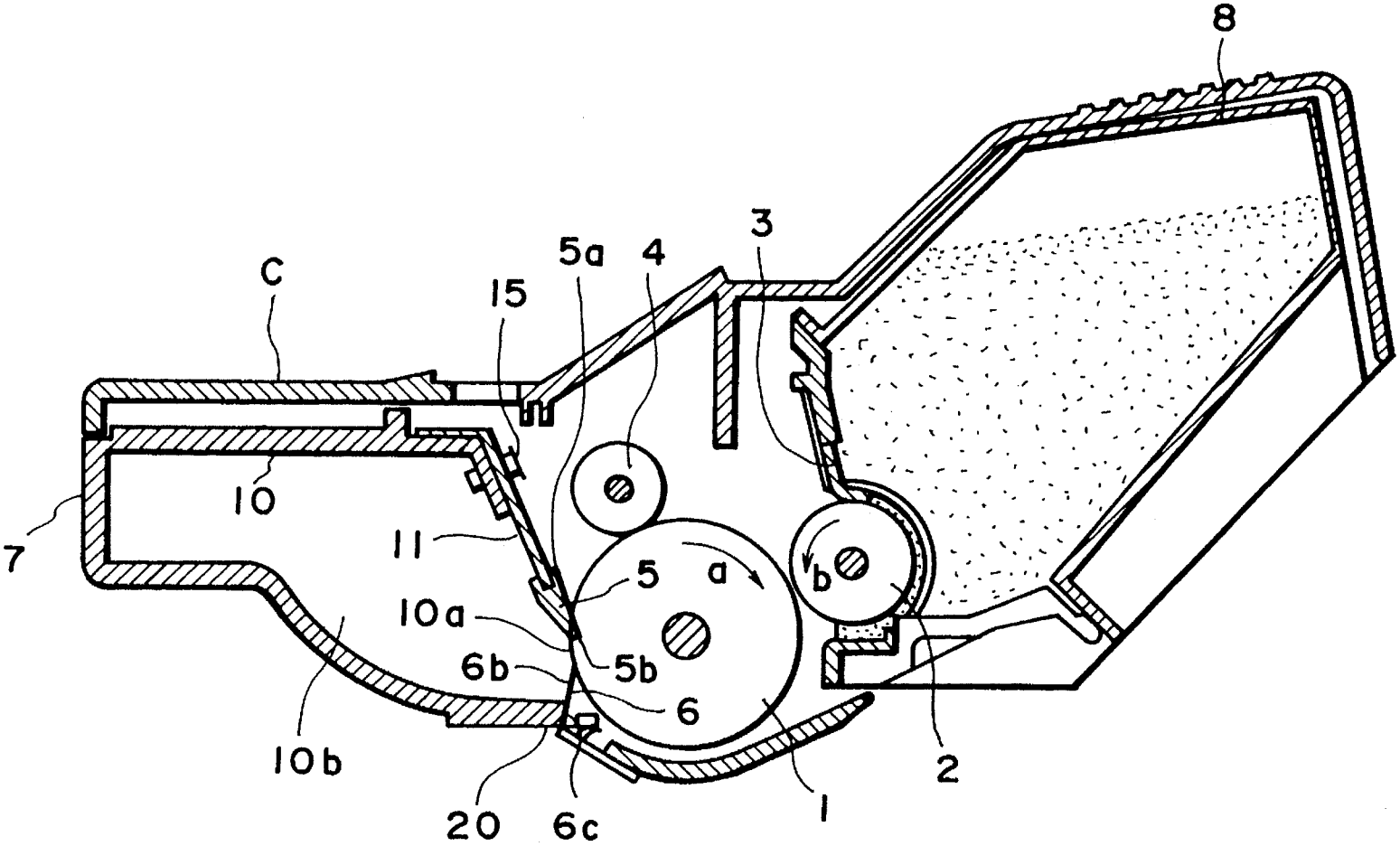
FIG. 11 is a sectional elevational view of a process cartridge according to a preferred embodiment of the present invention.

Next, a process cartridge and an image forming apparatus to which the above-mentioned embodiments can be applied will be explained with reference to FIGS. 10 and 11. Incidentally, while an example that an image forming apparatus which will be described later utilizes a process cartridge is illustrated, it should be noted that the present invention is not limited to this example, but can be applied to an image forming apparatus in which a process cartridge is not used.

First of all, a copying machine (image forming apparatus) and a process cartridge in which the cleaning apparatus according to one of the above-mentioned embodiments is used will be briefly explained with reference to FIGS. 10 and 11.

A photosensitive drum 1 is rotatably supported within a copying machine and is rotatingly driven in a direction shown by the arrow a by an appropriate drive means (not shown). Around the photosensitive drum 1, there are arranged, in order, a primary charger 4 for uniformly charging a surface of the photosensitive drum 1, a developing device 8 for forming a toner image by adhering toner to an electrostatic latent image formed on the photosensitive drum 1, and cleaning apparatus 7 for removing residual toner remaining on the photosensitive drum 1. The photosensitive drum 1, primary charger 4, developing device 8 and cleaning apparatus 7 are housed in a housing C1 to constitute a process cartridge C. Further, the process cartridge C is removable with respect to the copying machine. When the process cartridge C is mounted within the copying machine, the photosensitive drum 1 is arranged above a transfer charger 70 for transferring the toner image on the photosensitive drum 1 onto a transfer sheet P.

On the other hand, a lamp (exposure means) 61 for illuminating or lighting an original (not shown) rested on an original support 60 is disposed above the process cartridge C. Light emitted from the lamp 61 and reflected by the original passes through a lens 64 and an exposure opening 66 formed in the cartridge housing C1 to reach the photosensitive drum 1, thereby forming the electrostatic latent image. Further, a sheet stacking plate or tray 67 for stacking the transfer sheets P is mounted on a side of the copying machine. The transfer sheets P stacked on the stacking tray 67 are supplied one by one by a transfer sheet supply means comprised of a pick-up roller 68 and a pair of regist rollers 69 to be fed between the photosensitive drum 1 and the transfer charger 70 in registration with the rotation of the photosensitive drum i. In addition, the transfer sheet P to which the toner image is transferred by the transfer charger 70 is fed, via convey guides 71, 72, to a fixing rollers 73, where the toner image is permanently fixed to the transfer sheet. Thereafter, the transfer sheet is ejected out of the copying machine. Incidentally, a hot air discharging fan 75 is arranged above the fixing rollers 73. Further, there is provided a cartridge mounting means 59a, 59b on which the process cartridge C is removably mounted.

With the arrangement as mentioned above, the toner image formed on the photosensitive drum 1 is transferred onto the transfer sheet P. Incidentally, the developing device 8 contains the toner therein and has a rotatable developing sleeve 2. The developing sleeve 2 is rotatingly driven in a direction shown by the arrow b to feed the toner to a position opposed to the photosensitive drum 1. Further, an amount of the toner to be fed is regulated by a blade 3.

As mentioned above, according to the above-mentioned embodiments, since the seal member is firmly adhered to the cleaning container or the intermediate member, if an operator tries to peel the seal member or the adhesive member from the cleaning container or the intermediate member, the seal member or the adhesive member cannot be peeled from the cleaning container or the intermediate member, and, thus, for example, even when the residual toner removed from the photosensitive drum has been collected to the toner containing container, it is possible to prevent the leakage of such toner.

Further embodiments of the present invention will be explained with reference to FIGS. 12 to 14.

Incidentally, in embodiments described hereinbelow, guide member is more difficult to be peeled, by providing a cut-out in an end seal member.

Figure 12:
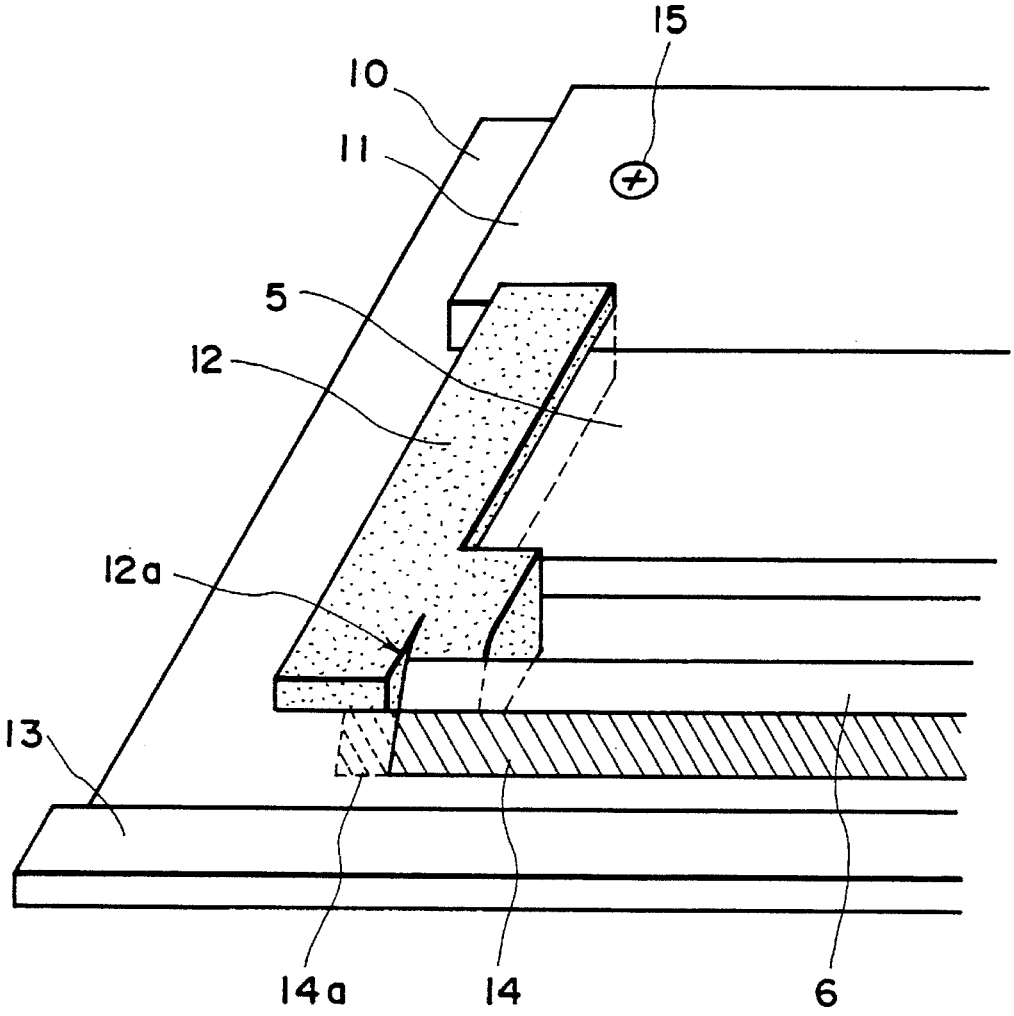
FIG. 12 is a partial perspective view of a cleaning apparatus according to a further embodiment of the present invention.

One end portion of a cleaning apparatus incorporated into a process cartridge removable with respect to an image forming system is shown in FIG. 12.

In this embodiment, a cleaning blade 5 made of urethane rubber and integrally formed with a blade supporting metal plate 11 is attached to a cleaning container 10 made of resin at a predetermined position by screws 15. Further, an end leak preventing member 12 made of foam polyurethane, felt, elastic rubber or an elastic body having a sheet member thereon is arranged at and closely matched to each side surface of the cleaning blade 5. Further, a dip sheet (same as a seal member) 6 is adhered to the cleaning container 10 via a dip sheet support (member to be mounted) 13 by a both-sided adhesive sheet 14, and the dip sheet 6 is overlapped on the end leak preventing members 12. That is to say, each end leak preventing member 12 is adhered to the container 10 across from a back surface (remote from the photosensitive drum 1) of the end portion of the dip sheet 6 to the side end of the cleaning blade 5. In this case, since the end leak preventing member 12 has a cut-out 12*a* along the end of the dip sheet 6, it is possible to reduce the reaction force F of the end leak preventing member 12 acting on the dip sheet 6, thereby preventing the peeling between the dip sheet support 13 and the both-sided adhesive sheet 14.

Incidentally, after the cleaning apparatus according to this embodiment has been left as it is for four weeks under the constant temperature of 50 ° C., the acceleration test for the peeling between the dip sheet support and the adhesive sheet was effected. As a result, it was found that no peeling was observed in the cleaning apparatus according to this embodiment. Further, after the acceleration test, the cleaning apparatus was incorporated into a process cartridge which was then mounted within an image forming apparatus, and 10,000 copies was obtained. As a result, it was found that the waste toner was not leaked, and, thus, the excellent technical effect of the present invention was ascertained.

A further embodiment of the present invention will be explained with reference to FIG. 13.

In this embodiment, a dip sheet is adhered to a cleaning container (member to be adhered) 10 in such a manner that the accuracy of an abutment angle and the accuracy of a penetrating amount of the dip sheet with respect to a photosensitive drum 1 are improved. The cleaning container is made of resin such as polystyrol, polyphenylene ether, polycarbonate, ABS or the like, and the adhesion holding force of such cleaning container is weaker than that of the material such as stainless steel from which the dip sheet support is made.

Figure 13:
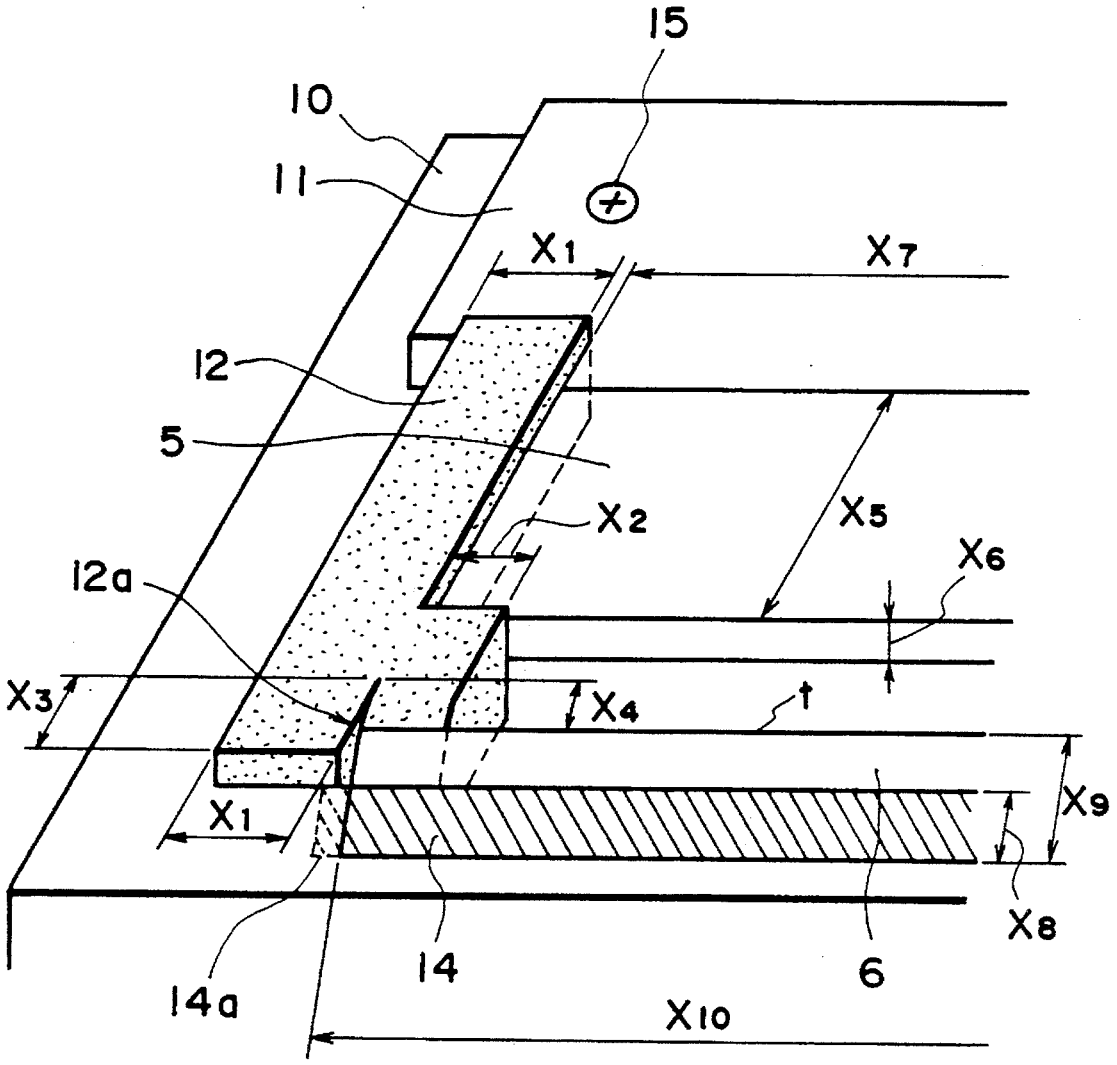
FIG. 13 is a partial perspective view of a cleaning apparatus according to a still further embodiment of the present invention.

FIG. 13 shows one end portion of a cleaning apparatus according to this embodiment. This embodiment is the same as that shown in FIG. 12, except that there is no dip sheet support 13 and the both-sided adhesive sheet 14 is directly adhered to the cleaning container 10.

As a result of the peeling acceleration test regarding the cleaning apparatus according to this embodiment effected in the same manner as that as mentioned above, it was found that the peeling phenomenon was not observed, and, with the arrangement according to this embodiment, it is possible to prevent the peeling between the resin (cleaning container) and the both-sided adhesive sheet, even regarding the resin having the poor adhesion holding force.

Incidentally, although the cleaning container is made of resin such as polystyrol, polyphenylene ether, polycarbonate or the like and the adhesion holding force of the resin is weaker than that of the material such as stainless steel from which the dip sheet support is made, according to this embodiment, it is possible to maintain the adequate adhesion force without occurring any peeling between members.

Figure 14:
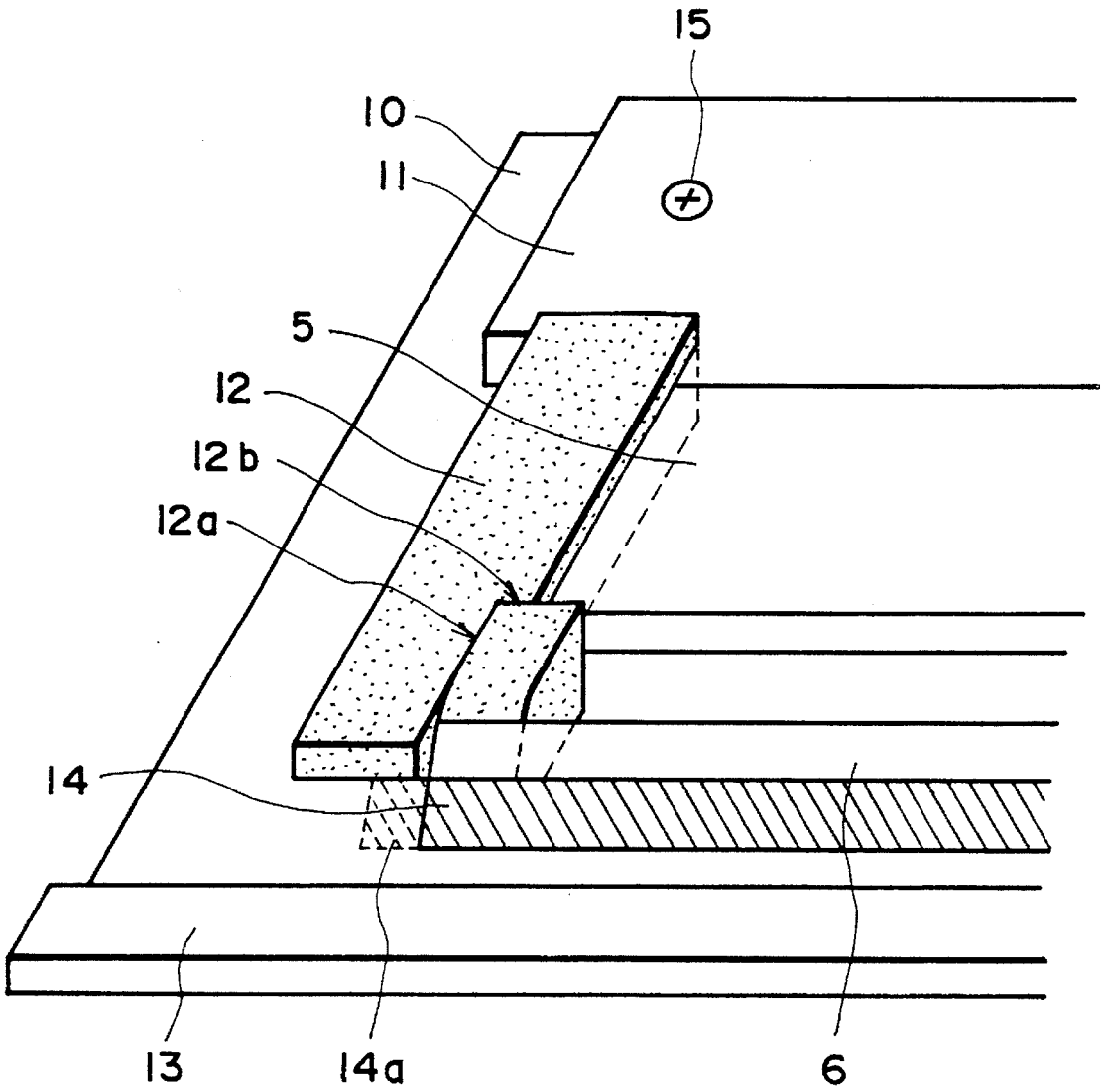
FIG. 14 is a partial perspective view of a cleaning apparatus according to the other embodiment of the present invention.

In the embodiments shown in FIGS. 12 and 13, while the cut-out 12*a* was formed in the end leak preventing member 12 only half way, as shown in FIG. 14, cut-outs 12*a*, 12*b* may be formed in the end leak preventing member from a side of the dip sheet 6 to a side of the cleaning blade 5.

As explained in connection with FIGS. 12 to 14, by providing the cut-out in the end leak preventing member, it is possible to prevent the peeling of the end of the dip sheet due to the reaction force of the end leak preventing member, thus preventing the leakage of the toner.

Incidentally, also in the embodiments shown in FIGS. 12 to 14, an adhesive member 14 such as a both-sided adhesive sheet may be protruded from both ends of the dip sheet 6 and such protruded portions of the adhesive member may be adhered to the container. In FIGS. 12 to 14, a condition that such protruded portion (14*a*) is adhered to the container is shown by the broken line.

Further, in FIG. 13, an example of sizes of various members or elements used in the embodiment of FIG. 13 is shown as follows;

(1) A width $X_1$ of a portion of the end leak preventing member disposed outwardly of the side surfaces of the cleaning blade 5 and the dip sheet 6 is about 5.5 mm;
(2) A width $X_2$ of a portion of the end leak preventing member disposed on the back surface of the dip sheet 6 (width of a portion of the end leak preventing member overlapped with the dip sheet 6) is about 2.0 mm;
(3) A length $X_3$ of the cut-out 12 is about 5.0 mm;
(4) A length $X_4$ of a portion of the cut-out 12 protruded from the back surface of the dip sheet 6 is about 0.9 mm;
(5) A width $X_5$ of the cleaning blade 5 protruded from the supporting metal plate 11 is about 10.5 mm;
(6) A thickness $X_6$ of the cleaning blade 5 is about 2.0 mm;
(7) A length $X_7$ of the cleaning blade 5 is about 244.3 mm;
(8) A width $X_8$ of an adhered portion of the dip sheet 6 is about 4.1 mm;
(9) A total width $X_9$ of the dip sheet 6 is about 7.9 mm;
(10) A length $X_{10}$ of the dip sheet 6 is about 241.3 mm;
(11) A thickness t of the dip sheet 6 is about 38 μm.

The other embodiments of the present invention will be explained with reference to FIGS. 15 to 25.

Figure 15:
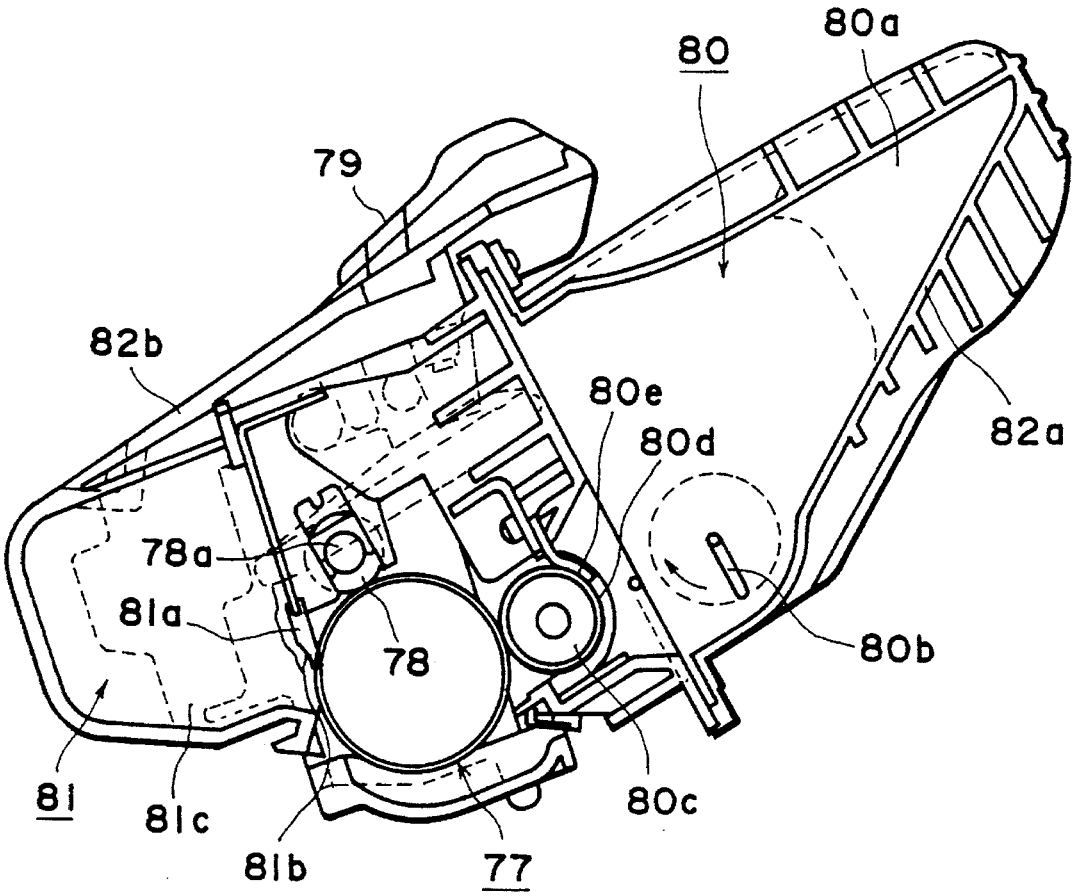
FIG. 15 is a side sectional view of a process cartridge having a cleaning apparatus therein.

First of all, a process cartridge to which one of the embodiments described later can be applied will be described with reference to FIG. 15. Incidentally, it should be noted that the embodiments described later can be applied to the aforementioned process cartridges. Further, a process cartridge described later is also removable with respect to the aforementioned image forming apparatus.

The process cartridge has an image bearing member, and at least one process means. Such process means may be, for example, a charger means for charging a surface of the image bearing member, a developing means for forming a toner image on the image bearing member, or a cleaning means for cleaning the residual toner from the image bearing member. As shown in FIG. 15, the process cartridge according to this embodiment comprises a charger means 78, an exposure means 79, a developing means 80 and a cleaning means 81 as the cleaning apparatus according to the present invention, which are disposed around an electrophotographic photosensitive drum 77, and these elements are enclosed by a housing 82 comprised of a first frame 82*a* and a second frame 82*b* to form a cartridge which can be removably mounted within an image forming apparatus.

Now, the developing means 80 has a toner reservoir 80*a* for containing toner, and a toner feeding member 80*b* rotated in a direction shown by the arrow to feed out the toner is disposed in the toner reservoir 80*a*. Further, a developing roller 80*d* having a magnet 80*c* therein and adapted to form a thin toner layer thereon by the rotation thereof is opposed to the photosensitive drum 77 with a small gap therebetween.

When the toner layer is formed on the surface of the developing roller 80, the frictional charge sufficient to develop an electrostatic latent image on the photosensitive drum 77 can be obtained due to the friction between the toner and the developing roller 80*d*. Further, a developing blade 80*e* is provided for regulating a thickness of the toner layer.

Further, a cleaning means 81 comprises a cleaning blade 81*a* contacted with the surface of the photosensitive drum 77 and adapted to remove or scrape off the residual toner on the drum 77, a dip sheet (guide member) 81*b* disposed below the blades 81*a* to dip and collect the removed toner and lightly contacted with the surface of the photosensitive drum 77, and a waste toner reservoir 81*c* for collecting the dipped toner. Incidentally, the dip sheet 81*b* is preferably made of polyethylene terephthalate having a thickness of about 50 μm or urethane rubber having a thickness of about 200 μm, and is adhered to the waste toner reservoir 81*c* by a both-sided adhesive tape.

Figure 16:
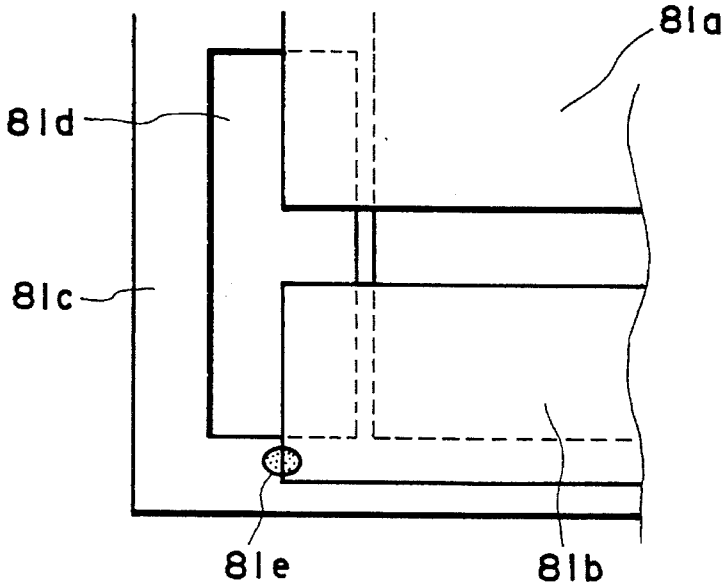
FIG. 16 is a partial view showing an embodiment wherein a longitudinal end of a dip sheet is sealed.

In this embodiment, a peel preventing means is constructed as shown in FIG. 16. That is to say, an end seal 81*d* made of foam polyurethane or the like is provided on each longitudinal end of the cleaning blade 81*a* and on each longitudinal end of the dip sheet 81*b* to prevent the toner from leaking between these ends and the waste toner reservoir 81*c* in such a manner that these longitudinal ends of the cleaning blade 81*a* and the dip sheet 81*b* are abutted against the end seal 81*d*. Accordingly, the dip sheet 81*b* is subjected to a reaction force from the end seals 81*d*. Thus, in this embodiment, portions of both longitudinal ends of the dip sheet 81*b* which are not overlapped with the end seals 81*d* are directly adhered to the waste toner reservoir 81*c* by adhesive 81*e* to seal these portions.

By sealing these portions, both longitudinal ends of the dip sheet 81*b* are firmly adhered to the waste toner reservoir 81*c*. Therefore, even when the dip sheet 81*b* is subjected to the reaction force from the end seals 81*d* for a long time, the dip sheet is not peeled from the reservoir. Incidentally, the sealing is not limited to the use of the adhesive 81*e*, but both longitudinal ends of the dip sheet 81*b* may be secured to the waste toner reservoir 81*c* by any appropriate means such as hot welding.

Figure 17:
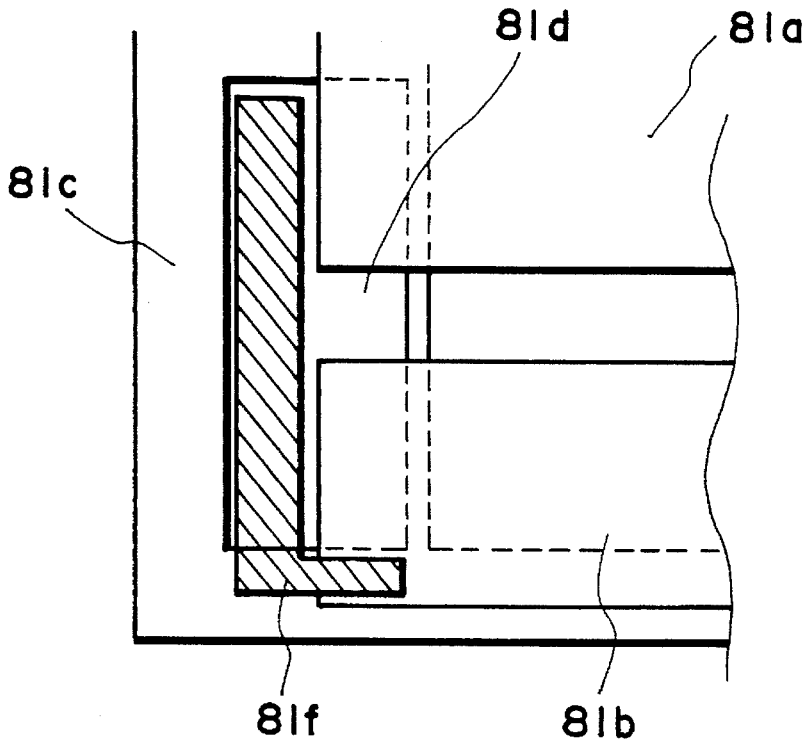
FIG. 17 is a partial view showing an embodiment wherein a protection sheet is adhered to a longitudinal end of a dip sheet.

While the above-mentioned peel preventing means performed the sealing of both longitudinal ends of the dip sheet 81*b*, protection sheets may be adhered to these ends. That is to say, as shown in FIG. 17, each end seal 81*d* provided on each longitudinal end of the cleaning blade 81*a* and on each longitudinal end of the dip sheet 81*b* is contacted with the photosensitive drum 77 to maintain the sealing ability between the end seal and the photosensitive drum 77. In this case, since the foam polyurethane from which the end seals 81*d* are made generates the great friction force with respect to the photosensitive drum 77, when the drum 77 is rotated while contacting with the end seals 81*d*, the greater rotational torque is required, and it is feared that the photosensitive drum 77 is damaged due to the friction between the drum and the end seals.

To avoid this, as shown in FIG. 17, a low friction sheet 81*f* made of high density polyethylene or the like is adhered to a portion of each end seal 81*d* which is contacted with the photosensitive drum 77. This sheet 81*f* is extended up to and adhered to the corresponding longitudinal end of the dip sheet 81*b*, thereby adhering and sealing the longitudinal end of the dip sheet 81*b*.

With this arrangement, it is possible to prevent the peeling of the dip sheet 81*b* and to reduce the rotational torque for rotating the photosensitive drum 77, thus preventing the damage of the surface of the photosensitive drum 77. Further, since the lower portions of the end seals 81*d* are covered by the sheets 81*f*, it is possible to prevent the peeling of the end seals 81*d* due to the rotation of the photosensitive drum 77.

Figure 18:
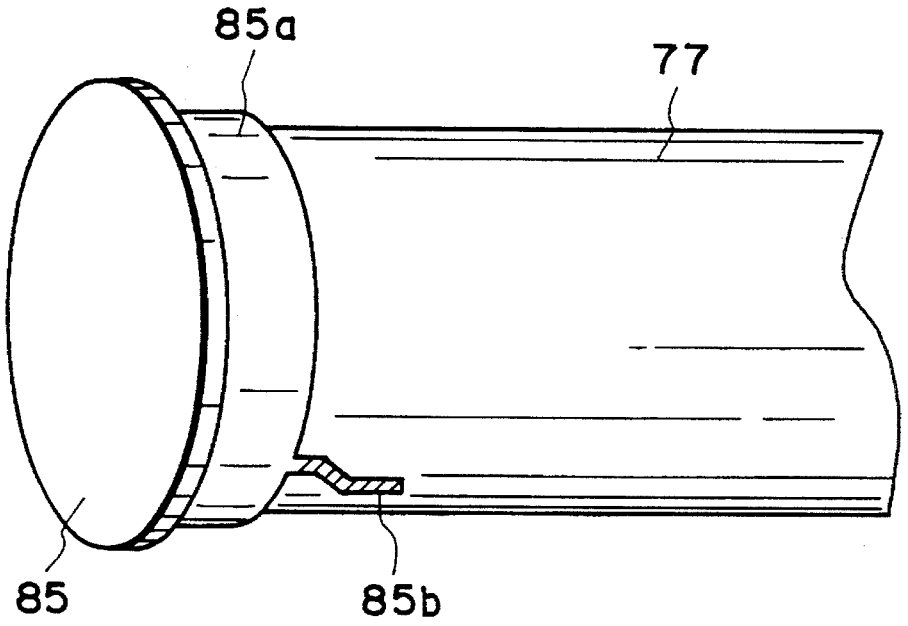
FIG. 18 is a partial view showing an embodiment wherein a hold-down portion is formed on a bearing for a photosensitive drum.
Figure 19:
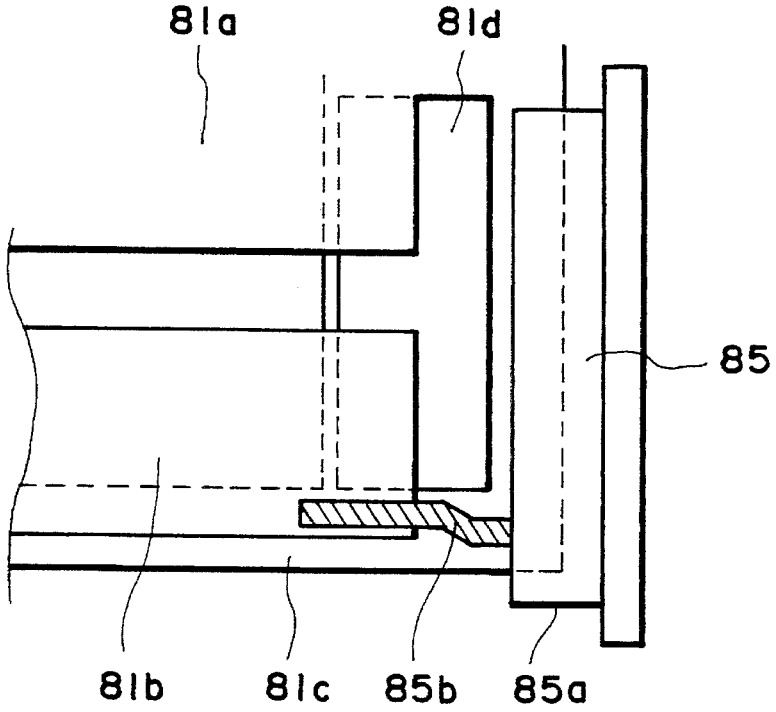
FIG. 19 is a partial view showing an embodiment wherein a longitudinal end of a dip sheet is held down by a hold-down portion formed on a bearing for a photosensitive drum.

Alternatively, the peel preventing means may be constructed as shown in FIGS. 18 and 19. That is to say, both ends of the photosensitive drum 77 are freely inserted into and rotatably supported by cylindrical receiving portions 85*a* of bearings 85, and the drum is rotated by a driving force from a motor (not shown). A dip sheet holder portion 85*b* is protruded from each bearing 85. As shown in FIG. 19, the dip sheet holder portion 85*b* is protruded onto the corresponding longitudinal end of the dip sheet 81*b* to urge the latter. Therefore, even when the dip sheet 81*b* is subjected to the reaction force from the end seals 81*d*, since the dip sheet is held down by the holder portions 85*b*, the dip sheet is not peeled.

Figure 20:
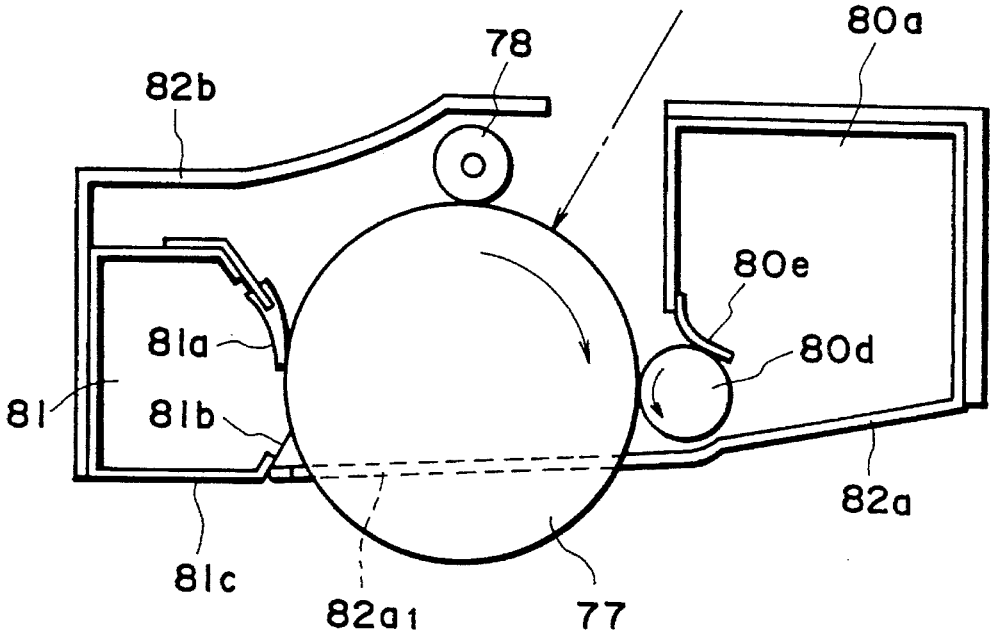
FIG. 20 is an elevational sectional view showing an embodiment wherein a longitudinal end of a dip sheet is held down by a frame.
Figure 21:
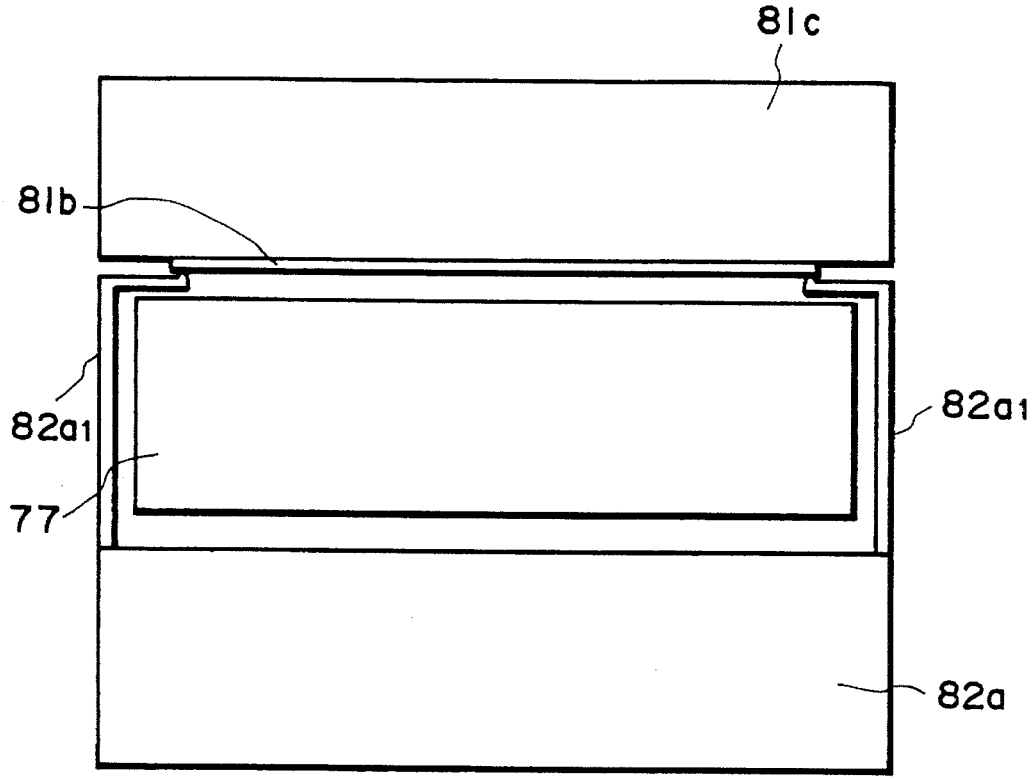
FIG. 21 is a plan view showing the embodiment of FIG. 20.
Figure 22:
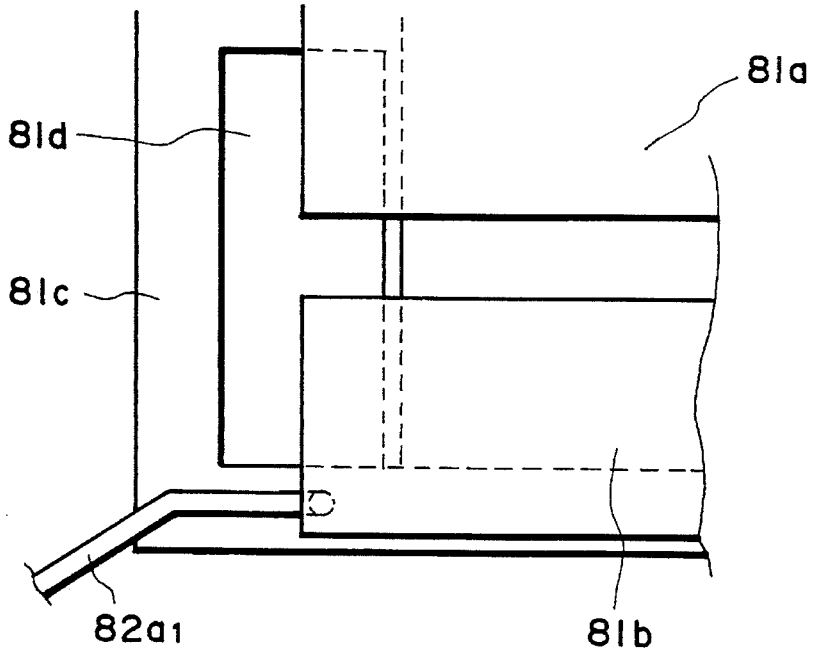
FIG. 22 is a partial view showing an end portion of the dip sheet according to the embodiment of FIG. 20.

In the aforementioned embodiment (FIGS. 18 and 19), while an example that both ends of the dip sheet 81*b* are held down by portions of the bearings 85 for the photosensitive drum 77 was explained, as shown in FIGS. 20 and 21, the dip sheet may be held down by the housing 82. Incidentally, FIG. 20 is a schematic elevational sectional view of a process cartridge showing the construction of a peel preventing means, FIG. 21 is a plan view of the cartridge, and FIG. 22 is a view showing one longitudinal end of the dip sheet 81*b*.

In this embodiment, arm portions 82*a*1 extending up to the dip sheet 81*b* are formed on lower end of the second frame 82*a* at both sides thereof so that both longitudinal ends of the dip sheet 81*b* are urged by the arm portions 82*a*1. Accordingly, also in this arrangement, it is possible to prevent the floating of both ends of the dip sheet 81*b* due to the reaction force of the end seals 81*d*, thereby preventing the peeling of the dip sheet.

In the aforementioned embodiments, while both longitudinal ends of the dip sheet 81*b* were prevented from peeling by sealing these longitudinal ends or by holding down these longitudinal end by the housing, the dip sheet may be difficult to be peeled, by increasing the adhesion area of the dip sheet 81*b*.

Figure 23:
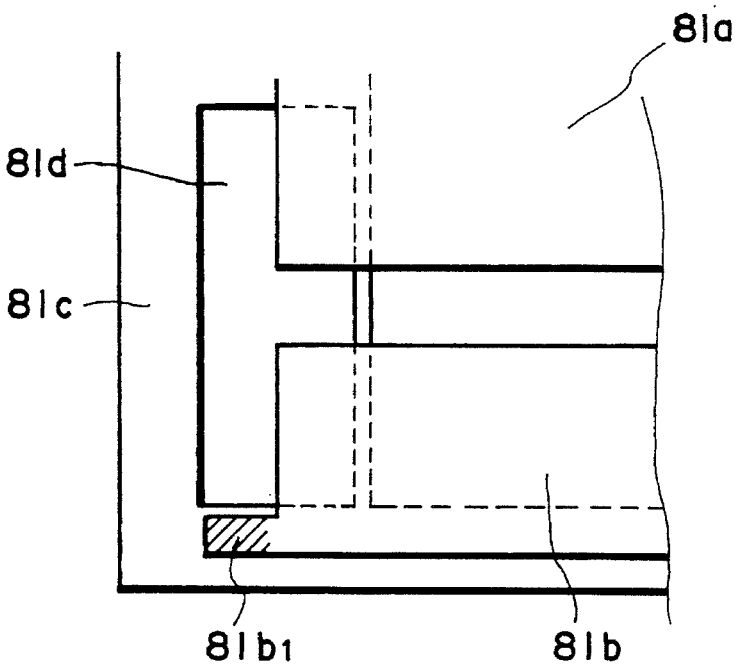
FIG. 23 is a partial view showing an embodiment wherein an extension is formed at a longitudinal end of a dip sheet which is not contacted with a photosensitive drum.

For example, as shown in FIG. 23, a lower side (lower portion in FIG. 23) of the dip sheet 81*b* which is not abutted against the photosensitive drum 77 are extended toward both longitudinal sides in comparison with an upper portion (upper side in FIG. 23) of the dip sheet which is abutted against the photosensitive drum, and these extended portions are adhered to the waste toner reservoir 81*c* by both-sided adhesive tapes. With this arrangement, in comparison with the conventional attachment of the dip sheet, the adhesion area of the dip sheet (via the adhesive tapes) is increased by an amount corresponding to the extended portions 81*b*1 (shown by the hatched area in FIG. 23), with the result that, even when the dip sheet 81*b* is subjected to the reaction force from the end seals 81*d*, the dip sheet is difficult to be peeled. Further, with this arrangement, since only the configuration of the dip sheet 81*b* may be altered and any additional elements are not required, it is possible to prevent the peeling of the dip sheet 81*b* without the cost-up.

Figure 24:
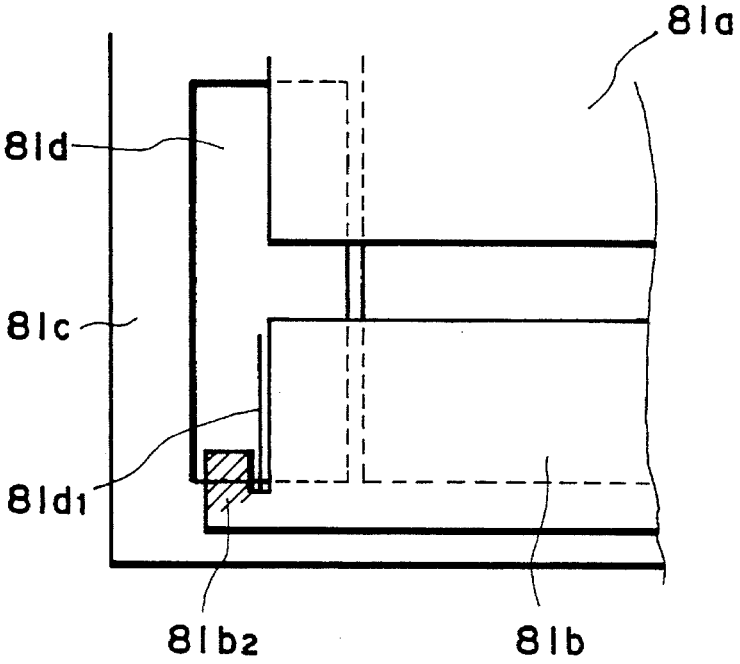
FIG. 24 is a partial view showing an embodiment wherein an extension is formed at a longitudinal end of a dip sheet which is not contacted with a photosensitive drum and a lower portion of an end seal is covered by the extension.

In the above embodiment (FIG. 23), while an example that the extended portions 81*b*1 of the dip sheet are adhered to the waste toner reservoir 81*c* was explained, as shown in FIG. 24, each sheet extended portion 81*b*2 may be extended not only longitudinally outwardly but also toward the corresponding end seal 81*d*, so that the extended portion 81*b*2 is adhered to the waste toner reservoir 81*c* and a lower portion of the end seal 81*d*. With this arrangement, the adhesion area of the dip sheet 81*b* (via the both-sided adhesive tapes) is increased, thereby providing the same advantage as that of the previous embodiment (FIG. 23) in the point that the dip sheet 81*b* becomes difficult to be peeled, and, further, it is possible to prevent the upward shifting of the end seals due to the rotation of the photosensitive drum 77, thereby preventing the end seals from peeling from the waste toner reservoir 81*c*.

Further, in this embodiment, a cut-out 81*d*1 is formed in each end seal 81*d*. Consequently, when the photosensitive drum 77 is urged against the end seals 81*d*, the end seals can deform and follow the profile of the photosensitive drum 77 due to the existence of the cut-outs 81*d*1, with the result that the end seals do not afford the excessive pressure to the photosensitive drum 77. Thus, it is possible to reduce the rotational torque for rotating the photosensitive drum 77, and to prevent the damage of the photosensitive drum due to the strong abutment between the longitudinal ends of the dip sheet 81*b* and the photosensitive drum 77.

Figure 25:
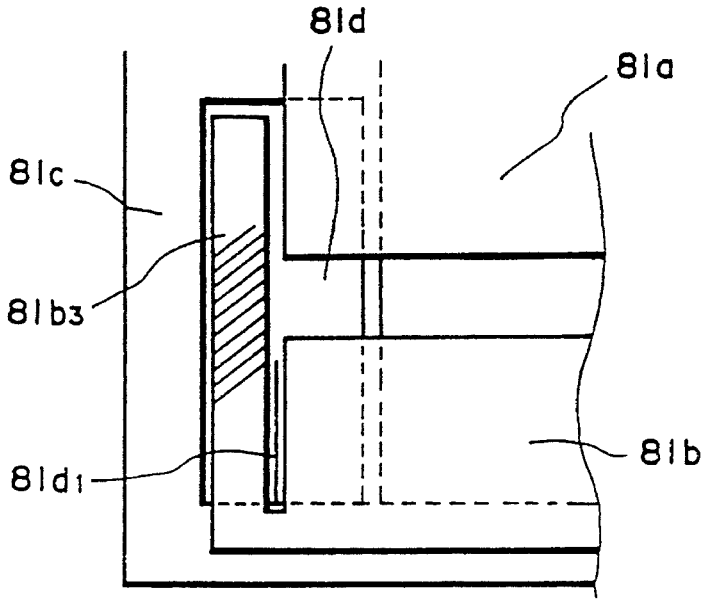
FIG. 25 is a partial view showing an embodiment wherein an extension is formed at a longitudinal end of a dip sheet which is not contacted with a photosensitive drum and an upper surface of an end seal is covered by the extension.

FIG. 25 shows an alteration of the above embodiment (FIG. 24). In this alteration, each extended portion 81*b*3 of the dip sheet 81*b* is extended not only longitudinally outwardly but also toward the corresponding end seal 81*d* greatly to cover the upper surface of the end seal, and the extended portion is adhered to the waste toner reservoir and the end seal.

By making the dip sheet 81*b* from polyethylene terephthalate or the like which can provide smaller friction force with "respect to the photosensitive drum 77, an area through which the photosensitive drum 77 is contacted with the end seals 81*d* having the greater friction force with respect to the drum is decreased, thereby reducing the frictional resistance during the rotation of the photosensitive drum 77. Accordingly, it is possible to prevent the peeling of the dip sheet 81*b*, to prevent the peeling of the end seals 81*d*, to reduce the rotational torque for rotating the photosensitive drum 77 and to prevent the damage of the surface of the photosensitive drum 77.

Incidentally, the process cartridge according to the aforementioned embodiments can be used not only to form a mono-color image as mentioned above, but also to form a color image (for example, two-color image, three-color image or full-color image) by providing a plurality of developing means.

Further, a developing method may be a conventional two-component magnet brush developing method, cascade developing method, touch-down developing method or cloud developing method.

Furthermore, in the aforementioned embodiment, while the charger means was of a so-called touch charging type, the charger means may be constructed by providing a laid C-shaped tungsten wire enclosed by metal (for example, aluminium) shields at three sides thereof wherein a high voltage is applied to the tungsten wire to generate positive or negative ions which are then transferred onto the surface of the photosensitive drum, thereby uniformly charging the surface of the photosensitive drum.

Incidentally, the charger means may be of blade (charging blade) type, pad type, block type, rod type or wire type, as well as roller type. Further, the cleaning means for removing the residual toner from the photosensitive drum may comprise a blade, a fur brush, magnet brush or the like.

Further, the aforementioned process cartridge includes an electrophotographic photosensitive drum as an image bearing member, and a cleaning means (as at least one process means). Accordingly, other than the above-mentioned embodiment, a process cartridge may incorporate therein, for example, an image bearing member, a charger means and a cleaning means as a unit which can be removably mounted within an image forming apparatus, or may incorporate therein an image bearing member, a developing means and a cleaning means as a unit while can be removably mounted within an image forming apparatus, or may incorporate therein an image bearing member and a cleaning means as a unit which can be removably mounted within an image forming apparatus. In other words, the process cartridge including the cleaning apparatus 7 according to the present invention may incorporate therein the primary charger 4 and the developing device 8, as well as the photosensitive drum 1 and the cleaning apparatus 7; however, the process cartridge is not limited to this, but may include integrally at least the photosensitive drum 1 and the cleaning device 7, and the process means such as the primary charger 4 and the developing device 8 may be omitted.

Further, in the above-mentioned embodiments, while an example that the residual toner is removed from the photosensitive drum as an image bearing member was explained, the present invention is not limited to this example, but may be applied to cases where the fixing rollers, charger roller or transfer roller are cleaned.

Furthermore, in the above-mentioned embodiments, while an example that the cleaning apparatus having the dip sheet is incorporated into the process cartridge was explained, the present invention may be applied to an image forming apparatus which does not utilize a process cartridge and wherein the above-mentioned cleaning apparatus is directly mounted within the image forming apparatus.

Further, in the above-mentioned embodiments, while the image forming apparatus was shown as the larger beam printer, the present invention is not limited to the laser beam printer, but may be applied to other image forming apparatus such as an LED printer, an electrophotographic copying machine, a facsimile apparatus or a word processor.

In the aforementioned embodiments, since there is provided the peel preventing means (such as the sealing) for preventing the peeling of both longitudinal ends of the sheet members for scraping off the toner on the image bearing member and for collecting the scraped toner, even when such longitudinal ends are subjected to the reaction force from the end seals, it is possible to prevent the peeling of these sheet members, thereby collecting the waste toner stably.

As mentioned above, according to the present invention, it is possible to prevent the leakage of the toner.

What is claimed is:

1. A cleaning apparatus for removing adhered matter from a member to be cleaned, said apparatus comprising:

cleaning means abutted against the member to be cleaned for removing the adhered matter therefrom;

receiving means for receiving the adhered matter removed from the member to be cleaned by said cleaning means;

a guide member for directing the adhered matter removed from the member to be cleaned by said cleaning means to said receiving means;

an adhesive member for adhering said guide member to said receiving means; and an end seal member provided on said guide member from a side of an end portion to a back surface thereof, wherein said adhesive member for adhering said guide member to said receiving means protrudes from a longitudinal end edge of said guide member.

2. A cleaning apparatus according to claim 1, wherein the member to be cleaned comprises an image bearing member and said receiving means opposes the image bearing member and comprises a toner containing container having an opening opposed to the image bearing member and adapted to direct toner removed from the image bearing member by said cleaning means to an interior of the container.

3. A cleaning apparatus according to claim 1, wherein said adhesive member comprises a both-sided adhesive tape.

4. A cleaning apparatus according to claim 1, wherein the member to be cleaned comprises an electrophotographic photosensitive body, and the adhered matter comprises toner.

5. A cleaning apparatus according to claim 1, wherein the member to be cleaned comprises an image bearing member and said guide member is lightly pressed against the image bearing member, so that residual toner on the image bearing member can pass through said guide member but toner removed from the image bearing member by said cleaning means is directed in a direction away from the image bearing member.

6. A cleaning apparatus according to claim 1, wherein said guide member comprises one of urethane, polyethylene terephthalate, and the like.

7. A cleaning apparatus according to claim 1, wherein said end seal member comprises foam material comprising one of felt, sponge, and the like.

8. A cleaning apparatus according to claim 1, wherein said receiving means comprises a toner containing container including resin comprising one of polystyrol, polyphenylene ether and the like.

9. A cleaning apparatus for removing adhered matter from a member to be cleaned, said apparatus comprising:

cleaning means abutted against the member to be cleaned for removing the adhered matter therefrom, said cleaning means comprising a cleaning blade;

receiving means for receiving the adhered matter removed from the member to be cleaned by said cleaning means;

a guide member for directing the adhered matter removed from the member to be cleaned by said cleaning means to said receiving means;

an adhesive member for adhering said guide member to said receiving means; and an end seal member provided on said guide member from a side of an end portion to a back surface thereof, wherein said end seal member provides a seal between said guide member and said receiving means and a seal between said cleaning blade and said receiving means, and wherein said adhesive member for adhering said guide member to said receiving means protrudes from a longitudinal end edge of said guide member.

10. A cleaning apparatus according to claim 1, wherein said receiving means comprises a toner containing container and said guide member is adhered to said toner containing container in such a manner that tension is applied to said guide member.

11. A cleaning apparatus according to claim 1, wherein said end seal member is disposed on an area extending from an end side of said guide member to an end side of said cleaning means.

12. A process cartridge mountable within an image forming system, said process cartridge comprising:

an image bearing member; and a cleaning apparatus comprising a cleaning means abutted against said image bearing member for removing adhered matter from said image bearing member, a receiving means for receiving the adhered matter removed from said image bearing member by said cleaning means, a guide member for directing the adhered matter removed from said image bearing member by said cleaning means to said receiving means, an adhesive member for adhering said guide member to said receiving means, and an end seal member provided on said guide member from a side of an end portion to a back surface of said guide member, wherein said adhesive member for adhering said guide member to said receiving means protrudes from a longitudinal end edge of said guide member.

13. A process cartridge according to claim 12, further comprising charger means for charging said image bearing member.

14. A process cartridge according to claim 12, further comprising developing means for developing a latent image formed on said image bearing member.

15. A process cartridge according to claim 12, wherein said cartridge has an exposure opening for exposing said image bearing member.

16. A process cartridge according to claim 12, wherein the process cartridge integrally incorporates therein an electrophotographic photosensitive body, and one of charger means, developing means and cleaning means, as a unit which can be removably mounted within the image forming system.

17. A process cartridge according to claim 12, wherein the process cartridge integrally incorporates therein an electrophotographic photosensitive body, and at least one of charger means, developing means and cleaning means, as a unit which can be removably mounted within the image forming system.

18. A process cartridge according to claim 12, wherein the process cartridge integrally incorporates therein at least an electrophotographic photosensitive body and cleaning means, as a unit which can be removably mounted within the image forming system.

19. An image forming apparatus within which a process cartridge can be mounted and adapted to form an image on a recording medium, said apparatus comprising:

mounting means for mounting a process cartridge comprising an image bearing member and a cleaning mechanism including cleaning means abutted against said image bearing member for removing adhered matter from said image bearing member, receiving means for receiving the adhered matter removed from said image bearing member by said cleaning means, a guide member for directing the adhered matter removed from said image bearing member by said cleaning means to said receiving means, an adhesive member for adhering said guide member to said receiving means, and an end seal member provided on said guide member from a side of an end portion to a back surface of said guide member, wherein said adhesive member for adhering said guide member to said receiving means protrudes from a longitudinal end edge of said guide member; and convey means for conveying the recording medium.

20. An image forming apparatus according to claim 19, wherein said image forming apparatus comprises an electrophotographic copying machine.

21. An image forming apparatus according to claim 19, wherein said image forming apparatus comprises a laser beam printer.

22. An image forming apparatus according to claim 19, wherein said image forming apparatus comprises a facsimile system.

23. An image forming apparatus for forming an image on a recording medium, said apparatus comprising:

an image bearing member;

developing means for developing a latent image formed on said image bearing member;

a cleaning mechanism including cleaning means abutted against said image bearing member for removing adhered matter from said image bearing member, receiving means for receiving the adhered matter removed from said image bearing member by said cleaning means, a guide member for directing the adhered matter removed from said image bearing member by said cleaning means to said receiving means, an adhesive member for adhering said guide member to said receiving means and an end seal member provided on said guide member from a side of an end portion to a back surface of said guide member, wherein said adhesive member for adhering said guide member to said receiving means protrudes from a longitudinal end edge of said guide member; and convey means for conveying the recording medium.

24. A cleaning apparatus for removing residual toner from an image bearing member, said apparatus comprising:

cleaning means for removing the residual toner from the image bearing member;

a toner containing container opposed to said image bearing member and adapted to receive the toner removed from the image bearing member;

a guide member adhered to said toner containing container and adapted to direct the toner removed from the image bearing member by said cleaning means to said toner containing container;

an end seal member provided on said guide member from a side of an end portion to a back surface of said guide member; and a peel preventing member adhered to said guide member and to said toner containing container.

25. A cleaning apparatus according to claim 24, wherein said peel preventing member is also adhered to said end seal member.

26. A cleaning apparatus according to claim 24, wherein said guide member is adhered to said toner containing container in such a manner that tension is applied to said guide member.

27. A process cartridge mountable within an image forming apparatus, said process cartridge comprising:

an image bearing member; and a cleaning apparatus including cleaning means for removing residual toner from said image bearing member, a toner containing container opposed to said image bearing member and adapted to receive the toner removed from said image bearing member, a guide member adhered to said toner containing container and adapted to direct the toner removed from said image bearing member by said cleaning means to said toner containing container, an end seal member provided on said guide member from Side of an end portion to a back surface of said guide member, and a peel preventing member adhered to said guide member and to said toner containing container.

28. A process cartridge according to claim 27, further comprising charger means for charging said image bearing member.

29. A process cartridge according to claim 27, further comprising developing means for developing a latent image formed on said image bearing member.

30. A process cartridge according to claim 27, wherein said process cartridge has an exposure opening for exposing said image bearing member.

31. An image forming apparatus within which a process cartridge can be mounted and adapted to form an image on a recording medium, said apparatus comprising:

mounting means for mounting a process cartridge comprising an image bearing member, and a cleaning apparatus including cleaning means for removing residual toner from said image bearing member, a toner containing container opposed to said image bearing member and adapted to receive the toner removed from said image bearing member, a guide member adhered to said toner containing container and adapted to direct the toner removed from said image bearing member by said cleaning means to said toner containing container, an end seal member provided on said guide member from a side of an end portion to a back surface of said guide member, and a peel preventing member adhered to said guide member and to said toner containing container; and convey means for conveying the recording medium.

32. An image forming apparatus according to claim 31, wherein said image forming apparatus comprises an electrophotographic copying machine.

33. An image forming apparatus according to claim 31, wherein said image forming apparatus comprises a laser beam printer.

34. An image forming apparatus according to claim 31, wherein said image forming apparatus comprises a facsimile apparatus.

35. An image forming apparatus for forming an image on a recording medium, said apparatus comprising:

an image bearing member;

a cleaning mechanism including cleaning means for removing residual toner from said image bearing member, a toner containing container opposed to said image bearing member and adapted to receive the toner removed from said image bearing member, a guide member adhered to said toner containing container and adapted to direct the toner removed from said image bearing member by said cleaning means to said toner containing container, an end seal member provided on said guide member from a side of an end portion to a back surface of said guide member, and a peel preventing member adhered to said guide member and to said toner containing container; and convey means for conveying the recording medium.

36. A cleaning apparatus for removing adhered matter from a member to be cleaned, said apparatus comprising:

cleaning means abutted against said member to be cleaned for removing the adhered matter from the member to be cleaned;

receiving means for receiving the adhered matter removed from the member to be cleaned by said cleaning means;

a guide member adhered to said receiving means and adapted to direct the adhered matter removed from the member to be cleaned by said cleaning means to said receiving means; and an end seal member provided on said guide member from a side of an end portion to a back surface of said guide member, wherein said end seal member has a cut-out portion extending along an end of said guide member.

37. A process cartridge mountable within an image forming apparatus, said process cartridge comprising:

an image bearing member; and a cleaning apparatus including cleaning means abutted against said image bearing member for removing adhered matter from said image bearing member, receiving means for receiving the adhered matter removed from said image bearing member by said cleaning means, a guide member adhered to said receiving means and adapted to direct the adhered matter removed from said image bearing member by said cleaning means to said receiving means, and an end seal member provided on said guide member from an end to a back surface of said guide member, wherein said end seal member has a cut-out portion extending along an end of said guide member.

38. An image forming apparatus within which a process cartridge can be mounted and adapted to form an image on a recording medium, said apparatus comprising:

mounting means for mounting a process cartridge comprising an image bearing member and a cleaning apparatus including cleaning means abutted against said image bearing member for removing adhered matter from said image bearing member, receiving means for receiving the adhered matter removed from said image bearing member by said cleaning means, a guide member adhered to said receiving means and adapted to direct the adhered matter removed from said image bearing member by said cleaning means to said receiving means, and an end seal member provided on said guide member from a side of an end portion to a back surface of said guide member, wherein said end seal member has a cut-out portion extending along an end of said guide member; and convey means for conveying the recording medium.

39. A cleaning apparatus for removing toner from an image bearing member, said apparatus comprising:

a cleaning member for removing the toner from the image bearing member;

receiving means for receiving the toner removed by said cleaning member;

a guide sheet member provided on said receiving means for guiding the toner removed by said cleaning member to said receiving means, one longitudinal edge of said guide sheet member being abutted against the image bearing member; and peel preventing means overlapping said receiving means and said guide sheet member, for preventing a longitudinal end of said guide sheet member from peeling off from said receiving means.

40. A cleaning apparatus according to claim 39, wherein said peel preventing means comprises a sealing member for sealing the longitudinal end of said guide sheet member.

41. A cleaning apparatus according to claim 39, wherein said peel preventing means comprises a frame abutted against the longitudinal end of said guide sheet member.

42. A process cartridge mountable within an image forming apparatus, said process cartridge comprising:

an image bearing member; and cleaning means for acting on said image bearing member to remove toner from said image bearing member, said cleaning means including a cleaning member for removing the toner from said image bearing member, receiving means for receiving the toner removed by said cleaning member, a guide sheet member provided on said receiving means for guiding the toner removed by said cleaning member to said receiving means, one longitudinal edge of said guide sheet member being abutted against said image bearing member, and peel preventing means overlapping said receiving means and said guide sheet member, for preventing a longitudinal end of said guide sheet member from peeling off from said receiving means.

43. An image forming apparatus within which a process cartridge can be mounted and adapted to form an image on a recording medium, said apparatus comprising:

mounting means for mounting a process cartridge comprising an image bearing member and cleaning means for cleaning toner from said image bearing member, said cleaning means including a cleaning member for removing the toner from said image bearing member, receiving means for receiving the toner removed by said cleaning member, a guide sheet member provided on said receiving means for guiding the toner removed by said cleaning member to said receiving means, one longitudinal edge of said guide sheet member being abutted against said image bearing member, and peel preventing means overlapping said receiving means and said guide sheet member, for preventing a longitudinal end of said guide sheet member from peeling off from said receiving means; and convey means for conveying the recording medium.

44. An image forming apparatus for forming an image on a recording medium, said apparatus comprising:

an image bearing member;

cleaning means for acting on said image bearing member to remove toner from said image bearing member, said cleaning means including a cleaning member for removing the toner from said image bearing member, receiving means for receiving the toner removed by said cleaning member, a guide sheet member provided on said receiving means for guiding the toner removed by said cleaning member to said receiving means, one longitudinal edge of said guide sheet member being abutted against said image bearing member, and peel preventing means overlapping said receiving means and said guide sheet member, for preventing a longitudinal end of said guide sheet member from peeling off from said receiving means; and convey means for conveying the recording medium.

45. An image forming apparatus according to claim 43, wherein said image forming apparatus comprises an electrophotographic copying machine.

46. An image forming apparatus according to claim 44, wherein said image forming apparatus comprises an electrophotographic copying machine.

47. An image forming apparatus according to claim 43, wherein said image forming apparatus comprises a laser beam printer.

48. An image forming apparatus according to claim 44, wherein said image forming apparatus comprises a laser beam printer.

49. An image forming apparatus according to claim 43, wherein said image forming apparatus comprises a facsimile apparatus.

50. An image forming apparatus according to claim 44, wherein said image forming apparatus comprises a facsimile apparatus.

51. A cleaning apparatus for removing toner remaining on a photosensitive member, said apparatus comprising:

a cleaning member for removing the toner on the photosensitive member;

toner receiving means for receiving the toner removed from the photosensitive member by said cleaning member; and a sheet member for introducing the toner removed from the photosensitive member by said cleaning member to said toner receiving means, one side of said sheet member being adhered to said toner receiving means, and the other side of said sheet member in a direction orthogonal to a longitudinal direction thereof being abutted onto the photosensitive member, the one side of said sheet member being longer than the other side of said sheet member in the longitudinal direction thereof.

52. A process cartridge removably mounted onto a main body of an image forming apparatus, said process cartridge comprising:

a photosensitive member; and a cleaning device for removing toner on said photosensitive member, said cleaning device including toner receiving means for receiving the toner removed from said photosensitive member by said cleaning device, and a sheet member for introducing the toner removed from said photosensitive member by said cleaning device to said toner receiving means, one side of said sheet member being adhered to said toner receiving means and the other side of said sheet member in a direction orthogonal to a longitudinal direction thereof being abutted onto said photosensitive member, the one side of said sheet member being longer than the other side of said sheet member in the longitudinal direction thereof.

53. An image forming apparatus onto which a process cartridge is removably mounted for forming an image on a recording medium, said apparatus comprising:

mounting means for removably mounting said process cartridge including a photosensitive member, a cleaning device for removing toner on said photosensitive member, said cleaning device including toner receiving means for receiving the toner removed from said photosensitive member by said cleaning device, and a sheet member for introducing the toner removed from said photosensitive member by said cleaning device to said toner receiving means, one side of said sheet member being adhered to said toner receiving means, and the other side of said sheet member in a direction orthogonal to a longitudinal direction thereof being abutted onto said photosensitive member, the one side of said sheet member being longer than the other side of said sheet member in the Longitudinal direction thereof; and convey means for conveying the recording medium.

54. An image forming apparatus for forming an image on a recording medium, said apparatus comprising:

a photosensitive member;

a cleaning member for removing toner on said photosensitive member;

toner receiving means for receiving the toner removed from said photosensitive member by said cleaning member;

a sheet member for introducing the toner removed from said photosensitive member by said cleaning member to said toner receiving meads, one side of said sheet member being adhered to said toner receiving means, and the other side of said sheet member in a direction orthogonal to a longitudinal direction thereof being abutted onto said photosensitive member, the one side of said sheet member being longer than the other side of said sheet member in the longitudinal direction thereof;

toner image forming means for forming a toner image on said photosensitive member;

transfer means for transferring the toner image on said photosensitive member onto the recording medium;

fixing means for fixing the toner image transferred onto the recording medium by said transfer means; and convey means for conveying the recording medium.

55. An image forming apparatus according to claim 53, wherein said image forming apparatus comprises an electrophotographic copying machine.

56. An image forming apparatus according to claim 54, wherein said image forming apparatus comprises an electrophotographic copying machine.

57. An image forming apparatus according to claim 53, wherein said image forming apparatus comprises a laser beam printer.

58. An image forming apparatus according to claim 54, wherein said image forming apparatus comprises a laser beam printer.

59. An image forming apparatus according to claim 53, wherein said image forming apparatus comprises a facsimile apparatus.

60. An image forming apparatus according to claim 54, wherein said image forming apparatus comprises a facsimile apparatus.

61. A cleaning apparatus for removing toner remaining on a photosensitive member, said apparatus comprising:

a cleaning member for removing toner on the photosensitive member; and a sheet member for guiding the toner removed by said cleaning member away from the photosensitive member and towards toner receiving means, one side of said sheet member being adapted to be adhered to the toner receiving means, and the other side of said sheet member in a direction orthogonal to a longitudinal direction thereof being adapted to be abutted onto the photosensitive member, the one side of said sheet member being longer than the other side of said sheet member in the longitudinal direction thereof.

62. A cleaning apparatus according to claim 48, wherein said cleaning member comprises a resilient material, a first longitudinal edge of said cleaning member being abutted against the image bearing member and a second longitudinal edge of said cleaning member being configured to be supported by a frame.

* * * * *

UNITED STATES PATENT AND TRADEMARK OFFICE

CERTIFICATE OF CORRECTION

PATENT NO. : 5,455,665 Page 1 of 3

DATED : October 3, 1995

INVENTOR(S) : Matsumi Baba, et al.

It is certified that error appears in the above-indentified patent and that said Letters Patent is hereby corrected as shown below:

COLUMN 2:

Line 65, "to" should read --to a--.

COLUMN 8:

Line 56, "drum i." should read --drum 1.--

COLUMN 9:

Line 56, "was" (first occurrence) should read --were--.

COLUMN 10:

Line 44, "follows;" should read --follows:--.

UNITED STATES PATENT AND TRADEMARK OFFICE

CERTIFICATE OF CORRECTION

PATENT NO. : 5,455,665 Page 2 of 3

DATED : October 3, 1995

INVENTOR(S) : Matsumi Baba, et al.

It is certified that error appears in the above-indentified patent and that said Letters Patent is hereby corrected as shown below:

COLUMN 13:

Line 1, "end" should read --ends--.

COLUMN 14:

Line 61, "larger" should read --laser--.

COLUMN 18:

Line 19, "Side" should read --side--.

UNITED STATES PATENT AND TRADEMARK OFFICE

CERTIFICATE OF CORRECTION

PATENT NO. : 5,455,665 Page 3 of 3

DATED : October 3, 1995

INVENTOR(S) : Matsumi Baba, et al.

It is certified that error appears in the above-indentified patent and that said Letters Patent is hereby corrected as shown below:

COLUMN 22:

Line 7, "Longitudinal" should read --longitudinal--; and

Line 20, "meads," should read --means,--.

Signed and Sealed this

Second Day of July, 1996

Bruce Lehman

Attest:

BRUCE LEHMAN

Attesting Officer

Commissioner of Patents and Trademarks